US008967054B2

(12) United States Patent
Henriott et al.

(10) Patent No.: US 8,967,054 B2
(45) Date of Patent: Mar. 3, 2015

(54) OFFICE DESKING SYSTEM

(75) Inventors: Jay M. Henriott, Jasper, IN (US); Keith E. Metcalf, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 133 days.

(21) Appl. No.: 13/484,925

(22) Filed: May 31, 2012

(65) Prior Publication Data

US 2012/0304900 A1 Dec. 6, 2012

Related U.S. Application Data

(60) Provisional application No. 61/493,184, filed on Jun. 3, 2011.

(51) Int. Cl.

| | |
|---|---|
| ***A47B 37/00*** | (2006.01) |
| ***A47B 81/00*** | (2006.01) |
| ***A47B 13/06*** | (2006.01) |
| ***A47B 21/00*** | (2006.01) |
| ***A47C 11/00*** | (2006.01) |

(52) U.S. Cl.

CPC ..... *A47B 81/002* (2013.01); *A47B 13/06* (2013.01); *A47B 21/00* (2013.01); *A47C 11/005* (2013.01); *A47B 2200/0014* (2013.01); *A47B 2200/12* (2013.01)

USPC ..... 108/50.02; 108/64; 108/147.19

(58) Field of Classification Search

CPC ..... A47B 87/002; A47B 21/06; A47B 9/00

USPC ..... 108/50.01, 50.02, 59, 64, 65, 102, 108/144.11, 147.19, 147.21, 155, 158.11, 108/180, 186; 312/194, 195

See application file for complete search history.

(56) References Cited

U.S. PATENT DOCUMENTS

| | | | |
|---|---|---|---|
| 287,913 | A | 11/1883 | Dawson et al. |
| 1,992,903 | A | 2/1935 | Potashnik |
| 2,022,399 | A | 11/1935 | Beiger |
| 2,378,852 | A | 6/1945 | James |
| D156,439 | S | 12/1949 | Lebensfeld |
| 2,599,020 | A | 6/1952 | Safstrom |
| 2,694,614 | A | 11/1954 | Dent |
| 2,733,786 | A | 2/1956 | Drake |

(Continued)

FOREIGN PATENT DOCUMENTS

| | | |
|---|---|---|
| CA | 2 519 168 | 2/1999 |
| CA | 2411421 | 5/2004 |

(Continued)

OTHER PUBLICATIONS

Knoll, "Dividends Horizon", Product Information, at least as early as Dec. 16, 2011.

(Continued)

*Primary Examiner* — Matthew Ing

(74) *Attorney, Agent, or Firm* — Faegre Baker Daniels LLP

(57) ABSTRACT

A modular desking system for an open plan office environment provides a variety of highly stable and variously configurable component parts which can be modularly combined with one another to provide a wide variety of desking styles and sizes. The user may decide among many options for linking various desking system assemblies with one another to create a larger desking assembly well suited to various open-plan office spaces.

13 Claims, 22 Drawing Sheets

(56) References Cited

U.S. PATENT DOCUMENTS 2,750,901 A 6/1956 McClellan
2,944,861 A 7/1960 Lessin
3,193,886 A 7/1965 Wenger et al.
3,229,790 A 1/1966 Shayne
3,426,480 A 2/1969 Dzamba
D217,261 S 4/1970 Gianfunga
3,509,665 A 5/1970 Bartlett et al.
D220,704 S 5/1971 Krammer
3,738,726 A 6/1973 Burst et al.
3,778,911 A 12/1973 Woolman
3,916,972 A 11/1975 Breiner
3,934,382 A 1/1976 Gartung
D244,114 S 4/1977 Neff
4,138,083 A 2/1979 Spiegel
4,145,849 A 3/1979 Shindoll et al.
4,169,417 A * 10/1979 Gemvik ..... 108/56.3
4,295,693 A 10/1981 Viklund
4,296,982 A 10/1981 Kullander
4,303,018 A 12/1981 Lehmann
4,448,003 A 5/1984 Hasbrouck
4,493,172 A 1/1985 Jones
4,535,577 A 8/1985 Tenser et al.
4,559,738 A 12/1985 Helfman
4,640,045 A 2/1987 Nesbitt et al.
4,642,926 A 2/1987 Friedman
4,645,878 A 2/1987 Hilger et al.
4,679,510 A 7/1987 Veyhl et al.
4,698,936 A 10/1987 Helfman
4,705,327 A 11/1987 Bollman
4,745,867 A 5/1988 Niemiec
4,762,072 A 8/1988 Boundy et al.
4,836,625 A 6/1989 Catta
4,838,177 A 6/1989 Vander Park
4,861,122 A 8/1989 Newhouse et al.
4,876,835 A 10/1989 Kelley et al.
4,883,330 A 11/1989 Armstrong et al.
4,905,428 A 3/1990 Sykes
4,907,388 A 3/1990 Siahatgar
4,914,873 A 4/1990 Newhouse
4,947,601 A 8/1990 McGuire
5,016,405 A 5/1991 Lee
5,058,331 A 10/1991 Epps
5,078,055 A 1/1992 Bellini et al.
5,083,512 A 1/1992 Newhouse et al.
5,092,253 A 3/1992 Grund et al.
5,103,741 A 4/1992 Grund et al.
5,106,173 A 4/1992 Kelley et al.
5,107,775 A 4/1992 Langlais et al.
5,116,004 A 5/1992 Luecke
5,160,188 A 11/1992 Rorke et al.
5,163,373 A 11/1992 Anderson et al.
5,186,425 A * 2/1993 Keusch et al. ..... 248/188.1
5,214,889 A 6/1993 Nienhuis et al.
5,214,890 A 6/1993 Levitan et al.
5,240,214 A 8/1993 Birnbaum et al.
5,309,686 A 5/1994 Underwood et al.
5,368,266 A 11/1994 Allen
D355,317 S 2/1995 Gutgsell
5,394,809 A * 3/1995 Feldpausch et al. ..... 108/147.21
5,406,760 A 4/1995 Edwards
5,428,928 A 7/1995 Hellwig et al.
5,431,210 A 7/1995 Nelson et al.
5,433,516 A 7/1995 Beals et al.
5,511,348 A 4/1996 Cornell et al.
5,522,324 A 6/1996 van Gelder et al.
5,544,593 A 8/1996 Canfield et al.
5,568,773 A 10/1996 Hung
5,588,376 A 12/1996 Seidl et al.
5,638,650 A 6/1997 Edwards
5,638,759 A 6/1997 Klugkist
5,638,762 A 6/1997 Chestnutt
5,642,593 A 7/1997 Shieh
5,715,633 A 2/1998 Raz et al.
5,715,760 A 2/1998 Frascaroli et al.
5,737,893 A 4/1998 Rossiter et al.
5,743,193 A 4/1998 Kakuta et al.
5,746,034 A 5/1998 Luchetti et al.
5,746,035 A 5/1998 Seiber et al.
5,752,449 A 5/1998 Simon et al.
5,802,789 A 9/1998 Goodman et al.
5,809,715 A 9/1998 Tanaka
5,813,178 A 9/1998 Edwards
5,816,000 A 10/1998 Izatt et al.
5,816,001 A 10/1998 Goodman et al.
5,823,102 A 10/1998 Will
5,826,385 A 10/1998 Dykstra et al.
5,833,206 A 11/1998 Peacock
5,852,904 A 12/1998 Yu et al.
5,875,597 A 3/1999 Gingrich et al.
5,881,500 A 3/1999 Latino et al.
5,881,518 A 3/1999 Edwards et al.
5,881,979 A 3/1999 Rozier, Jr. et al.
5,886,295 A 3/1999 Carino et al.
5,887,384 A 3/1999 Zaremba
5,890,325 A 4/1999 Corcorran et al.
D409,861 S 5/1999 Newhouse
5,899,025 A 5/1999 Casey et al.
5,899,035 A 5/1999 Waalkes et al.
5,899,036 A 5/1999 Seiber et al.
5,921,052 A 7/1999 Kemp
5,930,963 A 8/1999 Nichols
5,943,834 A 8/1999 Jeffers et al.
5,970,662 A 10/1999 Corcorran et al.
5,975,657 A 11/1999 LaCour
5,979,118 A 11/1999 Gortsema et al.
5,984,249 A 11/1999 Cohen
5,996,287 A 12/1999 Sullivan
6,009,675 A 1/2000 Waalkes et al.
6,009,676 A 1/2000 Feldpausch et al.
6,012,690 A 1/2000 Cohen
6,024,024 A 2/2000 Favaretto
6,044,612 A 4/2000 Shipman et al.
6,050,659 A 4/2000 LaCour
6,067,762 A 5/2000 Greer et al.
6,076,308 A 6/2000 Lyon et al.
6,076,474 A 6/2000 Grabowski et al.
6,108,971 A 8/2000 Zaremba
6,128,873 A 10/2000 Shipman et al.
6,131,347 A 10/2000 Hornberger et al.
6,134,845 A 10/2000 Shipman et al.
6,134,852 A 10/2000 Shipman et al.
6,158,180 A 12/2000 Edwards
6,161,347 A 12/2000 Yu et al.
6,167,676 B1 1/2001 Shipman et al.
6,173,543 B1 1/2001 Gortsema et al.
6,173,545 B1 1/2001 Feldpausch et al.
6,196,648 B1 3/2001 Henriott
6,223,485 B1 5/2001 Beck et al.
6,230,459 B1 5/2001 Jeffers et al.
6,244,002 B1 6/2001 Martin
6,256,941 B1 7/2001 Yu et al.
6,256,950 B1 7/2001 Laukhuf et al.
6,276,102 B1 8/2001 Shipman et al.
6,282,854 B1 9/2001 Vos et al.
6,283,043 B1 9/2001 Stern et al.
6,286,275 B1 9/2001 Edwards
6,286,276 B1 9/2001 Shipman et al.
6,327,983 B1 12/2001 Cronk et al.
6,349,516 B1 2/2002 Powell et al.
6,357,199 B2 3/2002 Laukhuf et al.
6,378,255 B1 4/2002 Eich et al.
6,389,773 B1 5/2002 Reuter et al.
6,393,783 B2 5/2002 Emaus
6,397,532 B1 6/2002 Shipman et al.
6,425,219 B1 7/2002 Barmak et al.
6,427,608 B1 8/2002 Crinion
6,446,396 B1 9/2002 Marangoni et al.
6,481,163 B1 11/2002 King et al.
6,481,169 B1 11/2002 Ludwig et al.
D470,349 S 2/2003 Risdall
6,553,731 B2 4/2003 Hsueh
6,585,028 B2 7/2003 Verdicchio
6,595,144 B1 * 7/2003 Doyle ..... 108/147
6,612,077 B2 9/2003 Parshad

(56) References Cited

U.S. PATENT DOCUMENTS

| | | | | |
|---|---|---|---|---|
| 6,658,805 | B1 | 12/2003 | Yu et al. | |
| 6,712,433 | B2 | 3/2004 | Hellwig et al. | |
| 6,718,717 | B2 | 4/2004 | Henderson et al. | |
| 6,725,784 | B2 | 4/2004 | Crinion | |
| 6,748,710 | B2 | 6/2004 | Gresham et al. | |
| 6,751,914 | B2 | 6/2004 | Zeh et al. | |
| 6,766,748 | B2 | 7/2004 | Insalaco et al. | |
| 6,775,953 | B2 | 8/2004 | Burken et al. | |
| 6,786,017 | B2 | 9/2004 | Thompson | |
| 6,792,876 | B2 | 9/2004 | Lin | |
| 6,807,776 | B2 | 10/2004 | Girdwood et al. | |
| 6,807,784 | B2 | 10/2004 | Hsueh | |
| 6,854,233 | B2 | 2/2005 | Pitsch et al. | |
| 6,857,712 | B1 | 2/2005 | Haberman | |
| 6,895,868 | B1 * | 5/2005 | Cronk et al. | 108/50.02 |
| 6,923,410 | B2 * | 8/2005 | Chang | 248/188.5 |
| 6,928,785 | B2 | 8/2005 | Shipman et al. | |
| 6,948,788 | B1 | 9/2005 | Tai | |
| D510,492 | S | 10/2005 | Sakurai et al. | |
| 6,951,085 | B2 | 10/2005 | Hodges et al. | |
| 6,986,556 | B2 | 1/2006 | Haberman | |
| 7,036,438 | B2 | 5/2006 | Okamoto et al. | |
| 7,055,287 | B2 | 6/2006 | Yu et al. | |
| 7,093,398 | B2 | 8/2006 | Spransy et al. | |
| 7,096,519 | B2 | 8/2006 | Ferreri et al. | |
| 7,125,088 | B2 | 10/2006 | Haberman | |
| 7,150,127 | B2 | 12/2006 | Underwood et al. | |
| 7,249,624 | B2 | 7/2007 | Zeh et al. | |
| 7,278,360 | B2 * | 10/2007 | Griepentrog | 108/50.02 |
| 7,310,918 | B1 | 12/2007 | Reuter et al. | |
| 7,377,078 | B2 | 5/2008 | Golina et al. | |
| 7,406,803 | B2 | 8/2008 | Haberman | |
| D575,970 | S | 9/2008 | Ward, Jr. et al. | |
| 7,469,642 | B1 | 12/2008 | DeDoux | |
| D599,145 | S | 9/2009 | Daino et al. | |
| 7,603,821 | B2 | 10/2009 | Eberlein et al. | |
| D608,568 | S | 1/2010 | Manz | |
| 7,703,398 | B2 | 4/2010 | Braüning et al. | |
| D618,477 | S | 6/2010 | Beukema et al. | |
| 7,789,025 | B2 | 9/2010 | Michaud, II et al. | |
| 7,802,407 | B2 | 9/2010 | Haberman | |
| 7,827,920 | B2 | 11/2010 | Beck et al. | |
| 7,841,142 | B2 | 11/2010 | Towersey et al. | |
| 7,856,777 | B2 | 12/2010 | Lamfers et al. | |
| 7,871,280 | B2 | 1/2011 | Henriott | |
| 7,975,445 | B2 | 7/2011 | Parshad et al. | |
| 8,104,850 | B2 | 1/2012 | Hager et al. | |
| 8,109,215 | B2 | 2/2012 | Kitada et al. | |
| 8,186,281 | B2 | 5/2012 | Bastian | |
| 8,276,523 | B2 | 10/2012 | Miller et al. | |
| 8,347,796 | B2 * | 1/2013 | Udagawa et al. | 108/155 |
| 8,393,122 | B2 | 3/2013 | Henriott et al. | |
| 2002/0079789 | A1 | 6/2002 | Grubb et al. | |
| 2002/0112411 | A1 | 8/2002 | Gravel et al. | |
| 2003/0196392 | A1 | 10/2003 | Edwards | |
| 2004/0093805 | A1 | 5/2004 | Underwood et al. | |
| 2004/0255535 | A1 | 12/2004 | Herren | |
| 2005/0263042 | A1 | 12/2005 | Martin et al. | |
| 2005/0268823 | A1 | 12/2005 | Bakker et al. | |
| 2005/0284341 | A1 | 12/2005 | Klassy et al. | |
| 2006/0162268 | A1 | 7/2006 | Eberlein et al. | |
| 2007/0007869 | A1 | 1/2007 | Kobayaski | |
| 2007/0114892 | A1 | 5/2007 | Boxenbaum et al. | |
| 2007/0251428 | A1 | 11/2007 | Mead et al. | |
| 2007/0294953 | A1 | 12/2007 | Guillen | |
| 2008/0067901 | A1 | 3/2008 | Chen | |
| 2008/0295744 | A1 | 12/2008 | Henriott | |
| 2008/0295745 | A1 | 12/2008 | Hamilton et al. | |
| 2009/0273260 | A1 | 11/2009 | Kemp | |
| 2009/0293402 | A1 | 12/2009 | Hamilton et al. | |
| 2010/0064597 | A1 | 3/2010 | Eberlein et al. | |
| 2010/0126394 | A1 | 5/2010 | Burak et al. | |
| 2010/0288168 | A1 | 11/2010 | Rheault et al. | |
| 2011/0036276 | A1 * | 2/2011 | Petrick et al. | 108/42 |
| 2012/0167500 | A1 | 7/2012 | Henriott | |
| 2012/0304900 | A1 | 12/2012 | Henriott et al. | |
| 2013/0061783 | A1 | 3/2013 | Bennie et al. | |

FOREIGN PATENT DOCUMENTS

| | | |
|---|---|---|
| EP | 0 096 272 | 12/1983 |
| EP | 0 200 514 | 4/1990 |
| EP | 0 443 202 | 6/1993 |
| EP | 0 594 939 | 5/1994 |
| EP | 0 458 264 | 10/1996 |
| FR | 2 633 168 | 12/1989 |
| GB | 2 226 057 | 6/1990 |
| JP | 3-177779 | 8/1991 |
| WO | 89/11572 | 11/1989 |
| WO | 20091052656 | 4/2009 |

OTHER PUBLICATIONS

Steelcase, "Answer", Product Information, Nov. 2011.
Teknion, Product Information, Feb. 28, 2011 and Sep. 26, 2011.
Allsteel, "Stride", Product Information, Aug. 2010 and May 2011.
Haworth, Product Information, May 2011.
Herman Miller, "Canvas", Product Information, Sep. 2011.
Knoll Inc., Product Information, "Fence", 2009.
Enwork, Product Information, "Grid", at least as early as Sep. 2012.
Office Action dated Sep. 25, 2013 in U.S. Appl. No. 13/799,646.
Office Action dated Nov. 7, 2013 in Canadian Application No. 2,778,652.
Sorrell, Ryan, "Clamped Table", Jul. 21, 2009.
Riiska, Andrew, "Belly Table", Jun. 23, 2009.
hitytp://www.dormbuys.com, "Collapsible Coffee Table", at least as early as May 31, 2012.
http://www.omtveyhl.com/ergonomic-office-furniture.php, Sep. 14, 2010.
http://www.haworth.com/en-us/Products/Featured-Collection/Pages/Planes-Height-Adjustable-Tables.aspx; see also http://www.haworth.com/en-us/Products/Furniture/Tables/Height-Adjustable/Pages/Planes.aspx, Sep. 14, 2010.
http://www.haworth-europe.com/en/products_all/systems/desk/kiron.php, Sep. 14, 2010.
http://www.inscapesolutions.com/products/desking/tisch/overview.cfm?prev_sc=5F557679-F1F9-D582-EE4A-039800154886, Sep. 14, 2010.
http://www.steelcase.co.uk/en/products/category/desk-tables/desk-systems/frameone/pages/overview.aspx, Sep. 14, 2010.
http://www.knoll.com/news/hstory.jsp?story_id=6161&type=Features&storyType=nf; see also http://www.knoll.com/neocon/10/neocon2010_prs.jsp, Sep. 14, 2010.

* cited by examiner

OFFICE DESKING SYSTEM

CROSS-REFERENCE TO RELATED APPLICATIONS

This application claims the benefit under Title 35, U.S.C. §119(e) of U.S. Provisional Patent Application Ser. No. 61/493,184, entitled OFFICE DESKING SYSTEM and filed on Jun. 3, 2011, the entire disclosure of which is hereby expressly incorporated by reference herein.

BACKGROUND

1. Field of the Disclosure

The present disclosure relates to office furniture and, in particular, relates to a desking system for use in an open plan office environment.

2. Description of the Related Art

Many known office furniture systems are based on partition systems for use in subdividing an open floor plan office space into substantially private individual spaces such as offices, meeting rooms, and reception areas, for example.

Recently, many office furniture systems have been designed in accordance with more spatially open aesthetics, and are based on desking systems and modular tables, for example, to promote interaction and collaboration between office workers.

SUMMARY

The present disclosure provides a modular desking system for an open plan office environment. The desking system provides a variety of highly stable and variously configurable component parts which can be modularly combined with one another to provide a wide variety of desking styles and sizes. The user may decide among many options for linking various desking system assemblies with one another to create a larger desking assembly well suited to various open-plan office spaces.

One embodiment of the desking system includes a height-adjustable table which includes leg assemblies having vertical columns disposed at a 45° angle with respect to horizontal feet of the table leg assemblies for increased structural stability. In another embodiment, a return bracket is provided which facilitates the mounting of a desk return to a table while accommodating various depths of work surfaces for both the table and the return. In another embodiment, a table assembly includes a modular table leg that may be configured as a freestanding leg assembly or as a back-to-back pedestal arrangement, each optionally including a vertical stanchion to accommodate a privacy panel assembly and/or shelves or modular storage components disposed above work surface height. Interchangeable modular leg assemblies for the tables are also provided. A beam-based seating system is disclosed, which includes a tapered post mounting feature for task chair assemblies that facilitates mounting of task chair assemblies to a common beam while preserving task chair functions such as rotation, backrest recline, and seat depth adjustment.

In one form thereof, the present disclosure provides a table leg assembly, comprising: a foot member extending along a horizontal foot longitudinal axis; and a vertical column member secured to the foot member, the vertical column member having at least two walls each oriented at an acute angle with respect to the horizontal foot longitudinal axis.

In another form thereof, the present disclosure provides a table assembly, comprising: a first table leg assembly; a first beam mounted to the first table leg assembly, the first beam defining a first longitudinal beam extent; a first work surface mounted atop the first beam; a second table leg assembly; a second beam mounted to the second table leg assembly, the second beam defining a second longitudinal beam extent oriented substantially perpendicular to the first longitudinal beam extent; a second work surface mounted atop the second beam; and a bracket connecting the first beam and the second beam, the second beam adjustably connected to the bracket between a first position and a second position, such that when the second beam is connected to the bracket in the first position, the second beam is located a first distance from the first beam, and when the second beam is connected to the bracket in the second position, the second beam is located a second distance from the first beam, the first distance different than the second distance.

In yet another form thereof, the present disclosure provides a back-to-back table assembly comprising: a leg assembly comprising: a first leg extending between a first lower end and an opposed first upper end; a second leg extending between a second lower end and an opposed second upper end, the second leg spaced apart from the first leg to define a span therebetween; a support extending transversely between the first upper end and the second upper end to affix the first leg to the second leg; and a suspended vertical stanchion extending upwardly from the support, the suspended vertical stanchion disposed at a location along the support that is spaced from the first upper end and from the second upper end; a work surface supported by the leg assembly and extending along at least a portion of the support, the work surface defining a work surface height above the first and second lower ends of the first and second legs; and an elongate vertical panel supported by the suspended vertical stanchion, the elongate vertical panel disposed at or above the work surface.

In yet another form thereof, the present disclosure provides a back-to-back table assembly including a first pedestal assembly including a first front end and an opposing first rear end, a second pedestal assembly including a second front end and an opposing second rear end, at least one elongate panel connecting the first pedestal assembly and the second pedestal assembly such that the first rear end of the first pedestal assembly is spaced from the second rear end of the second pedestal assembly with a first opening between the first rear end and the second rear end, a first work surface mounted atop the first pedestal assembly, the first work surface including a first rear edge, and a second work surface including a second rear edge, the second work surface mounted atop the second pedestal assembly with a second opening between the first rear edge of the first work surface and the second rear edge of the second work surface.

In still another form thereof, the present disclosure provides a table assembly including a beam, a work surface mounted atop the beam, and a plurality of different leg assemblies each removably attachable to the beam.

In yet another form thereof, the present disclosure provides a chair assembly including a leg assembly, a modular horizontal support rail mounted to the leg assembly, the modular horizontal support rail including at least one tapered chair mounting member, and a first chair assembly connected to the tapered chair mounting member, the first chair assembly including at least one of a rotation mechanism, a reclining mechanism, and a seat depth adjustment mechanism.

BRIEF DESCRIPTION OF THE DRAWINGS

The above mentioned and other features and objects of this disclosure, and the manner of attaining them, will become more apparent and the disclosure itself will be better understood by reference to the following description of embodiments of the disclosure taken in conjunction with the accompanying drawings, wherein.

Figure 1:
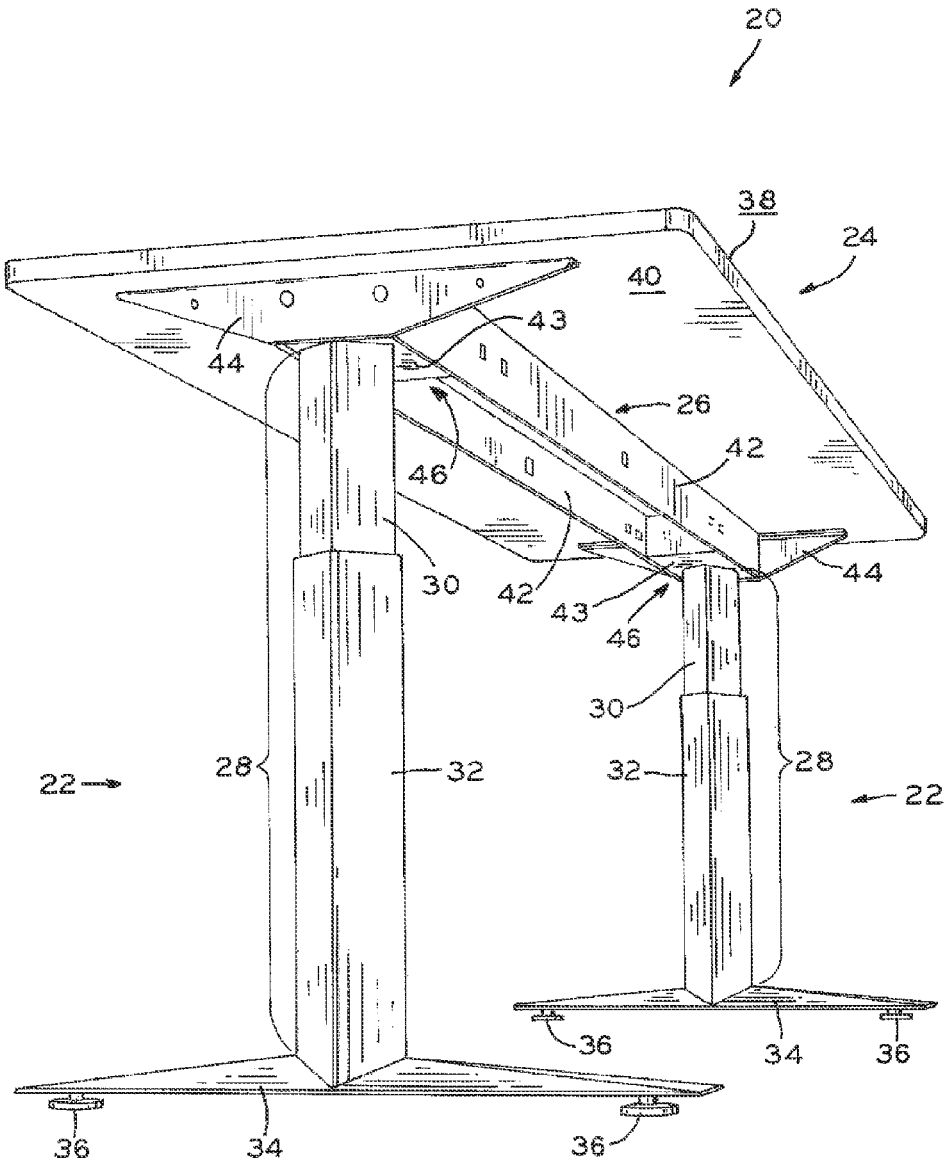
FIG. 1 is a perspective view of a table assembly including a table leg assembly in accordance with an exemplary embodiment of the present disclosure, a work surface support assembly, and a work surface.

Corresponding reference characters indicate corresponding parts throughout the several views. Although the exemplifications set out herein illustrate embodiments of the disclosure, the embodiments disclosed below are not intended to be exhaustive or to be construed as limiting the scope of the disclosure to the precise form disclosed.

DETAILED DESCRIPTION

1. Work Surface Support Assembly with Stabilizing Legs

Figure 2:
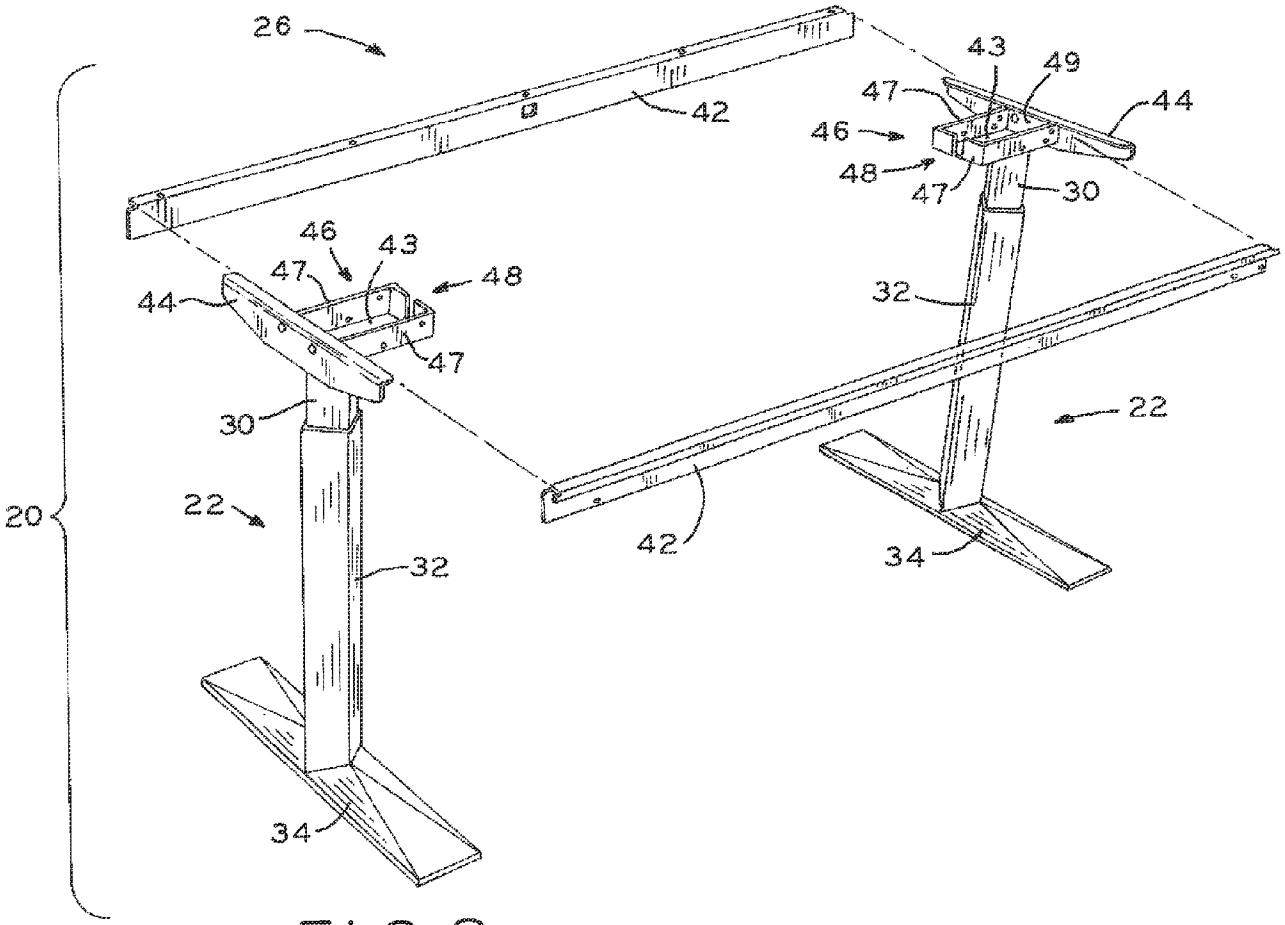
FIG. 2 is an exploded perspective view of the table leg and work surface support assemblies of FIG. 1.

Referring to FIG. 1, table assembly 20 includes height adjustable leg assemblies 22, work surface 24, and work surface support assembly 26. Work surface 24 includes top surface 38 and opposing bottom surface 40 and is supported on leg assemblies 22 and work surface support assembly 26 such that work surface 24 provides a stable work surface for an office resident. Work surface support assembly 26 secures work surface 24 to leg assemblies 22, as shown in FIGS. 1 and 2. Work surface support assembly 26 includes horizontal rails 42 (FIGS. 1 and 2) each having a generally J-shaped cross-section, end brackets 44 (FIG. 6), and bracket support member or bracket box member 46 (FIG. 6) including bottom wall 43, sidewalls 47 and end caps 49. At least one of sidewalls 47 defines opening 48.

Referring to FIGS. 1-3B, leg assemblies 22 are coupled to opposing ends of work surface 24 to support and stabilize work surface 24. Leg assemblies 22 each include vertical column 28 having upper telescoping member 30 slidably mounted within lower telescoping member 32 (as will be discussed in more detail below), and horizontal foot 34 having floor mounts 36 (FIG. 1) which may be adjustable to act as levelling glides. Vertical column 28 and horizontal foot 34 together define a generally inverted T-shaped assembly. Floor mounts 36 optionally include a high-friction material disposed at the bottom surface thereof, as commonly used with existing table leg assemblies to provide a non-slip interface between leg assemblies 22 and a floor surface.

Figure 6:
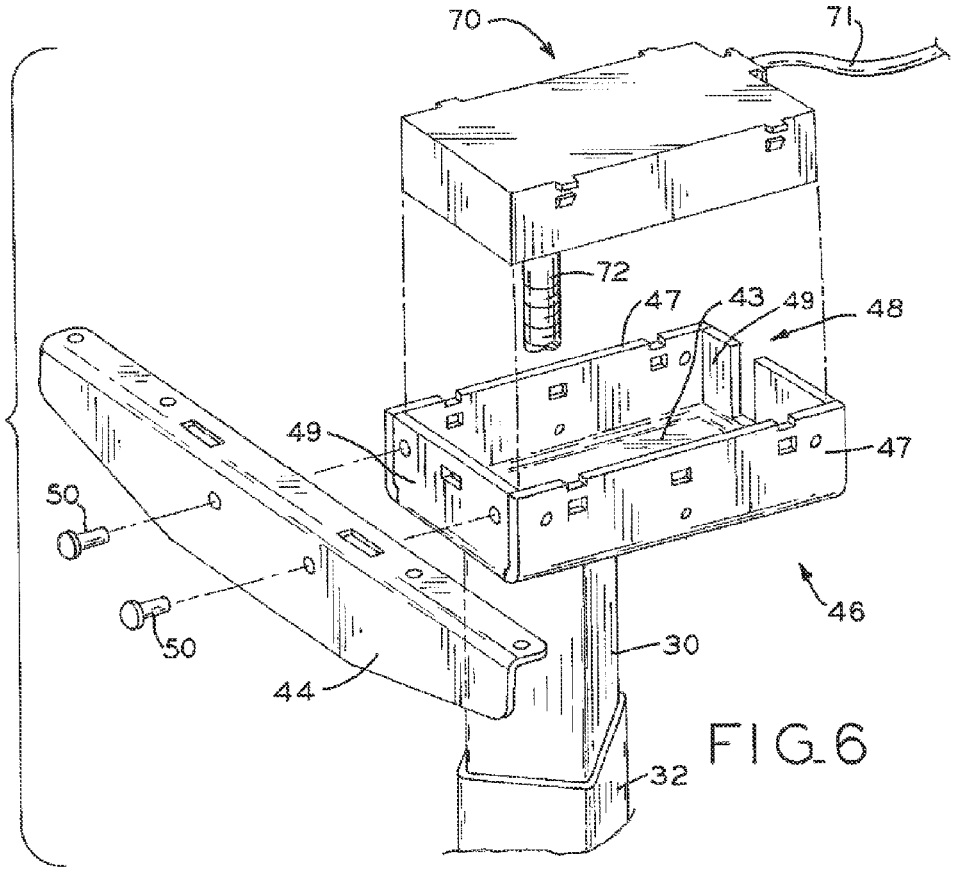
FIG. 6 is an exploded perspective view of a portion of the leg assembly and the work surface support assembly of FIG. 1, further showing an electronic drive assembly in accordance with an exemplary embodiment of the present disclosure.

Referring to FIGS. 1, 2 and 6, an exemplary use of work surface support assembly 26 to secure work surface 24 to leg assemblies 22 will now be described. Bracket support member 46 is secured to a top end of upper telescoping member 30 of vertical column 28, such as by welding. Next, end bracket 44 is positioned abutting or adjacent to bracket connecting end cap 49 of bracket support member 46, such that respective fastener apertures of bracket support member 46 and end bracket 44 are aligned as shown in FIG. 6. Fasteners 50 are then received in the aligned fastener apertures to secure end bracket 44 to bracket support member 46.

As illustrated in FIG. 2, first ends of respective horizontal rails 42 are then positioned abutting or adjacent to respective sidewalls 47 of bracket support member 46 of a first leg assembly 22 and opposing second ends of horizontal rails 42 are positioned abutting or adjacent to respective sidewalls 47 of a second leg assembly 22, such that respective fastener apertures of horizontal rails 42 and corresponding apertures in the various adjacent sidewalls 47 are aligned. Fasteners are then received in the aligned fastener apertures to secure the first and second ends of horizontal rails 42 to respective bracket support members 46 of the first and second leg assemblies 22. In an exemplary embodiment, opposing ends of horizontal rails 42 directly abut respective interior portions of end brackets 44 as shown in FIG. 1 to form a stable mounting platform therebetween.

With the support foundation thus assembled, work surface 24 having a desired width can be positioned atop work surface support assembly 26 and leg assemblies 22. A plurality of fasteners can be used to secure work surface 24 to work surface support assembly 26 in a conventional manner.

Horizontal rails 42 (FIG. 2) can be provided in varying lengths to adjust a distance between leg assemblies 22. By varying such distance between leg assemblies 22, a stable support foundation can be provided for various different work surface sizes to create finished table assemblies adapted to fit various different spaces. To this end, multiple pairs of horizontal rails 42 can be provided as a kit including various different lengths to allow for leg assemblies 22 to be used in various different table sizes.

Figure 3A:
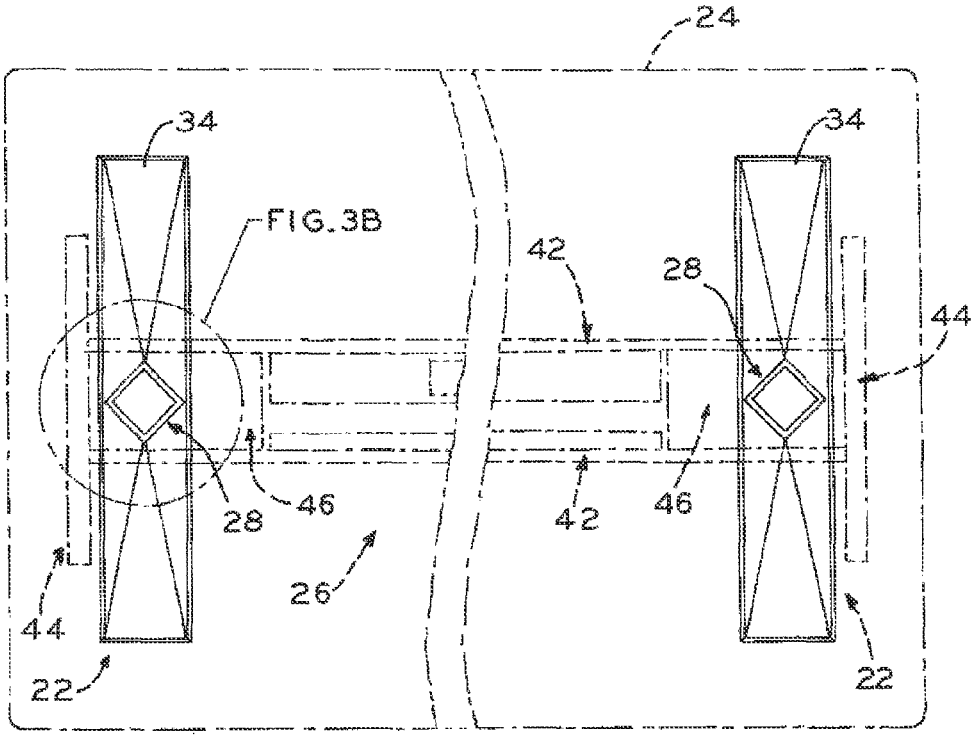
FIG. 3A is a plan view of the leg assembly and the work surface support assembly of FIG. 1, with the work surface of FIG. 1 shown in dashed lines.
Figure 3B:
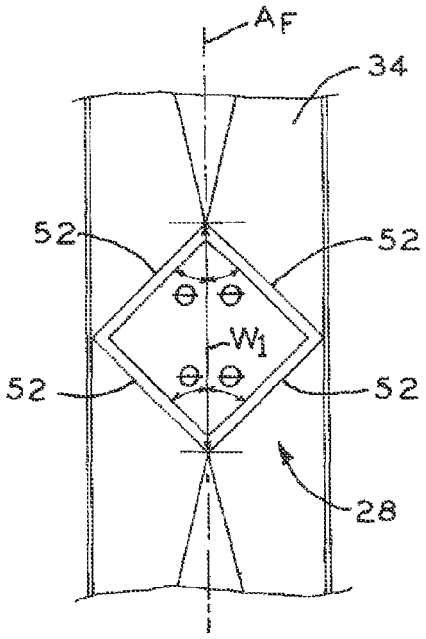
FIG. 3B is a detailed, fragmentary view of a portion of FIG. 3A.

As best shown in FIGS. 3A and 3B, vertical column members 28 have a quadrilateral (e.g., square as illustrated) cross-sectional shape including four walls 52. In the exemplary illustrated embodiment, foot members 34 are generally elongate structures extending along horizontal foot longitudinal axis $A_F$ (FIG. 3B). Vertical column members 28 are secured to respective foot members 34 with each of walls 52 of vertical column members 28 oriented 45° from foot longitudinal axis $A_F$ as shown in FIG. 3B. Vertical column members 28 are secured to work surface 24 via bracket support member 46 in the same orientation, i.e., with each of walls 52 of vertical column members 28 oriented 45° from foot longitudinal axis $A_F$, as shown in FIGS. 1-3A. By orienting vertical columns 28 in this manner, leg assemblies 22 are stronger and provide greater stability to work surface 24 when a typical load is applied to work surface 24, as described in detail below.

For purposes of the present disclosure, vertical column member 28 oriented at 45 degrees with respect to foot longitudinal axis $A_F$ is described in detail. However, it is contemplated that the benefits of angling the surfaces of table legs made in accordance with the present disclosure can be realized with other leg geometries and arrangements. In one embodiment, vertical column member may have any non-circular cross-sectional profile including at least two walls oriented at an acute angle with respect to longitudinal axis $A_F$. Such non-circular cross-sectional profile may be a polygonal shape, such as a triangle, quadrilateral (as illustrated), pentagon, hexagon, heptagon or octagon, for example. Such non-circular cross section may form an open geometry, such as an L-shaped or C-shaped elongate structure with at least two surfaces arrangeable at an acute angle with respect to longitudinal axis $A_F$. In another example, the non-circular cross-section may form a closed geometry including two or more surfaces arrangeable at an acute angle with respect to longitudinal axis $A_F$, and other surfaces with are arcuate.

Figure 4:
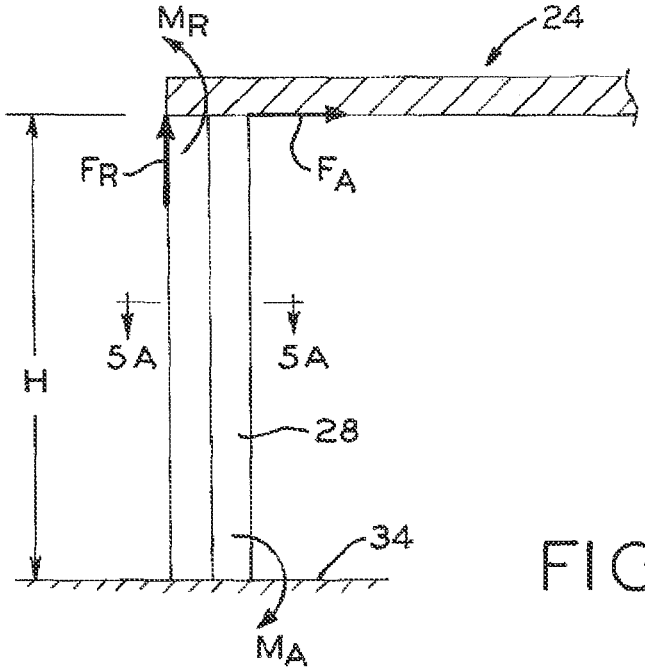
FIG. 4 is a free body diagram of the table leg assembly and the work surface of FIG. 1.
Figure 5A:
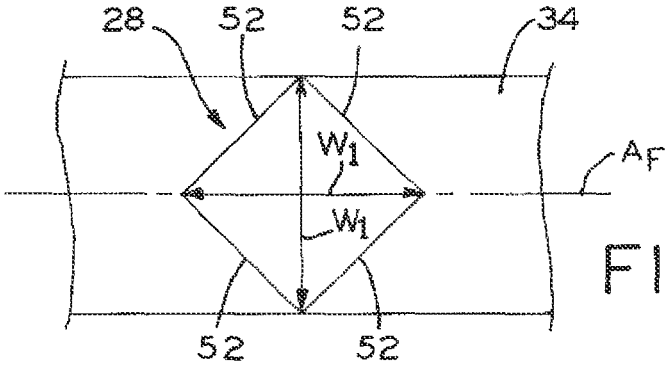
FIG. 5A is a cross-sectional view taken along line 5A-5A of FIG. 4.
Figure 5B:
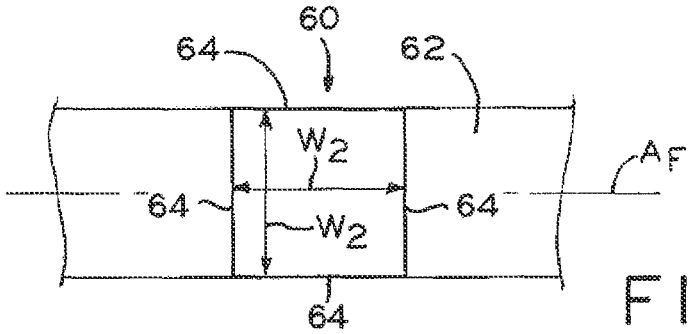
FIG. 5B PRIOR ART
FIG. 5B is a cross-sectional view similar to FIG. 5A of a known table leg assembly.

Referring now to FIGS. 4-5B, forces exerted on a generally rectangular work surface are typically applied perpendicular to two of the work surfaces edges (and, therefore, parallel to the other two edges). For example, when a user of a rectangular work surface pushes on the edges of the table (i.e., by grasping the edge of the table while sliding a chair inwardly or outwardly), the forces applied to the table are typically perpendicular to the edge nearest the user (and parallel to the side edges). Similarly, a user will typically slide objects across a table either directly toward or directly away from the nearest edge of the table, creating shear force vectors that are perpendicular to the nearest edge. Alternatively, the user may slide objects side-to-side, creating shear force vectors that are parallel to the nearest edge. For purposes of the present disclosure, these edge-perpendicular and edge-parallel forces are referred to as inward/outward forces, i.e., the forces created by pushing or pulling on an edge of a rectangular work surface.

In the context of table assembly 20, such inward/outward forces are applied transverse to the longitudinal extent of work surface support assembly 26. This is because such longitudinal extent runs along the direction of horizontal rails 42 between the spaced-apart leg assemblies 22, and a work surface is then mounted such that the long edge of the work surface is substantially parallel to such longitudinal extent (e.g., as shown in FIG. 3A with respect to work surface 24). Thus, an inward/outward forces applied to the work surface as described above is exemplified by applied force $F_A$ shown in FIG. 4. Force $F_A$ creates equal and opposite moments acting on opposing ends of vertical column member 28 of leg assembly 22. More particularly, application of inward/outward force $F_A$ to work surface 24 induces moment $M_A$ between vertical column member 28 of leg assembly 22 and foot member 34. Moment $M_A$ is equal to the height H of vertical column member 28 multiplied by force $F_A$ applied to the work surface. Dynamic forces and moments are negligible and can be ignored in the present example because vertical column member 28 is secured to foot member 34 and work surface 24 in a fixed manner, i.e., vertical column member 28 cannot appreciably slide or bend relative to foot member 34 or work surface 24 by application of force in normal use.

Thus, given that vertical column member 28 is not significantly moved or accelerated by application of force $F_A$, interaction between vertical column member 28 and work surface 24 must induce an equal, opposite moment $M_R$ to counteract moment $M_A$ (FIG. 4). The moment force $M_R$ induced in vertical column member 28 to counteract the moment force $M_A$ is equal to width $W_1$ (FIG. 5A) of vertical column member 28 multiplied by the reactionary force exerted by vertical column member 28 on the undersurface of the tabletop, e.g., exemplified by force $F_R$ in FIG. 4. As described below, maximizing width $W_1$ minimizes reaction force $F_R$, thereby stabilizing work surface 24. For a given cross-sectional size of leg assembly 22, such maximization is assured by a rotational configuration in accordance with the present disclosure.

Referring to FIGS. 5A and 5B, for example, an exemplary vertical column member 28 may have a 70 mm by 70 mm square cross section. Thus, each wall 52 of vertical column member 28 (FIG. 5A) is 70 mm wide, and each wall 64 of existing leg assembly 60 (FIG. 5B) is also 70 mm wide. However, as shown in FIG. 5A, vertical column member 28 is secured to foot member 34 in accordance with the present disclosure, such that each of walls 52 of vertical column members 28 is oriented at a 45° angle with respect to foot longitudinal axis $A_F$. Therefore, width $W_1$ of vertical column member 28 can be calculated using Pythagorean's Theorem as equal to $(70^2+70^2)^{1/2}$, or approximately 98.99 mm.

By comparison to FIG. 5B, existing leg assembly 60 is shown secured to foot member 62 such that walls 64 are each either perpendicular or parallel to longitudinal axis $A_F$. Thus, width $W_2$ is simply equal to the length of wall 64, or 70 mm.

By securing vertical column member 28 to foot member 34 in accordance with the present disclosure (i.e., with each of walls 52 of vertical column member 28 oriented 45° from foot longitudinal axis $A_F$ as shown in FIGS. 3B and 5A), width $W_1$ of vertical column member 28 is effectively increased by approximately 28.99 mm as compared to existing leg assembly 60 of FIG. 5B, representing an effective increase in length of over 41%. This effective increase in length enhances the operational stability of work surface 24 without increasing the size, weight or shape of vertical column member 28.

More specifically, moment $M_R$ exerted by vertical column member 28 is equal and opposite to moment $M_A$ induced by application of force $F_A$, as discussed above. Further, the top end of vertical column 28 is also attached at 45 degrees with respect to bracket support member 46 (FIG. 6) and therefore is ultimately attached at 45 degrees with respect to the edges of work surface 24 (FIG. 1). Thus, moment $M_R$ is equal to the product of either width $W_1$ or width $W_2$ of vertical column member 28 and the reactionary force $F_R$, depending on whether the present vertical column member 28 or the existing leg assembly 60 is employed. Thus, it can be seen that the increase in effective width $W_1$ as compared to effective width $W_2$ yields a proportionate decrease in reaction force $F_R$ for a given applied force $F_A$. As a result, an inward/outward load applied to work surface 24 gives rise to less stress is exerted on vertical column member 28 and work surface 24 at the junction therebetween, such that leg assembly 22 of the present disclosure is stronger and provides greater stability to work surface 24 as compared to existing leg assemblies, e.g., existing leg assembly 60.

Turning again to FIG. 6, electronic drive assembly 70 may optionally be used in conjunction with leg assembly 22. In the illustrated exemplary embodiment, electronic drive assembly 70 is received in bracket support member 46. Electronic drive assembly 70 includes wire 71, which passes through opening 48 of bracket support member 46 and connects to an electrical power source to provide power to an electric motor (not shown) disposed within electronic drive assembly 70. Drive shaft 72 is connected to the electric motor disposed in electronic drive assembly 70 and extends from electronic drive assembly 70 into a bore (not shown) in a top wall of upper telescoping member 30 of leg assembly 22. In alternative embodiments, a gear set (not shown) is included with the electric motor disposed in electronic drive assembly 70 and drive shaft 72.

A remote control device is provided at a user edge of work surface 24 to allow an office resident to remotely control adjustment of leg assemblies 22. For example, actuation of the electronic remote control device actuates the electric motor disposed in electronic drive assembly 70 which rotates drive shaft 72 which is rotatably connected to a screw drive assembly within vertical column member 28 to control raising and lowering of leg assemblies 22 in a known manner. In one embodiment, a level control feature is included in each leg assembly 22 to monitor the number of rotations of each screw drive assembly within respective vertical column members 28 to ensure each leg assembly 22 is at the same vertical position, thereby ensuring that work surface 24 remains level. Exemplary electronic drive mechanisms that can be used in accordance with the present disclosure are available from OMT-Veyhl USA Corporation of Holland, Mich.

2. Work Surface Support Assembly with Modular Work Surfaces

Figure 9:
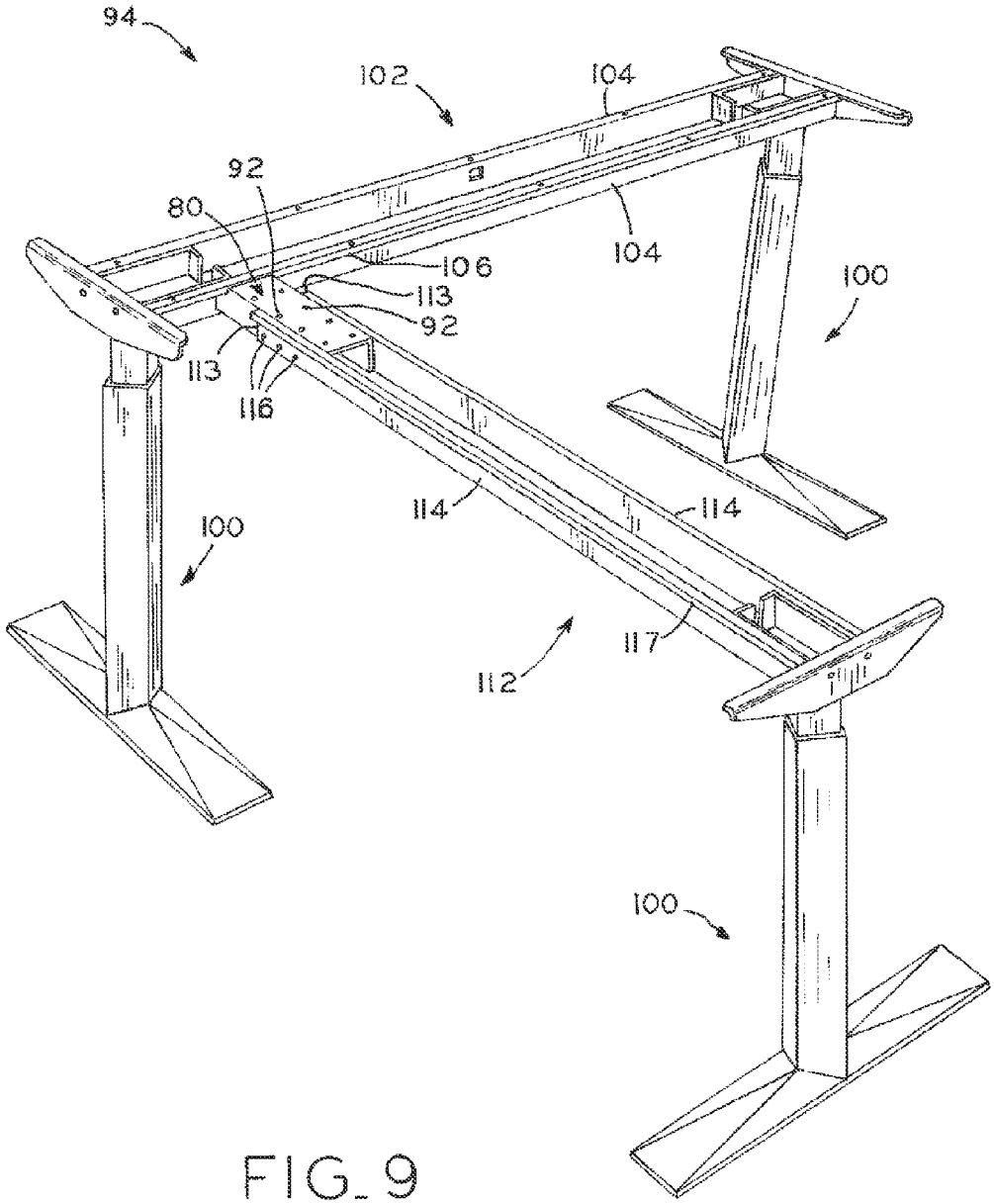
FIG. 9 is a perspective view of the table assembly of FIG. 8A.

As shown in FIG. 9, a table assembly 94 may be provided in accordance with the present disclosure that is capable of supporting multiple work surfaces. The work surfaces are modularly configurable in a plurality of configurations using return bracket 80, which allows for a variety of spatial arrangements of leg assemblies 100, 110.

Figure 7:
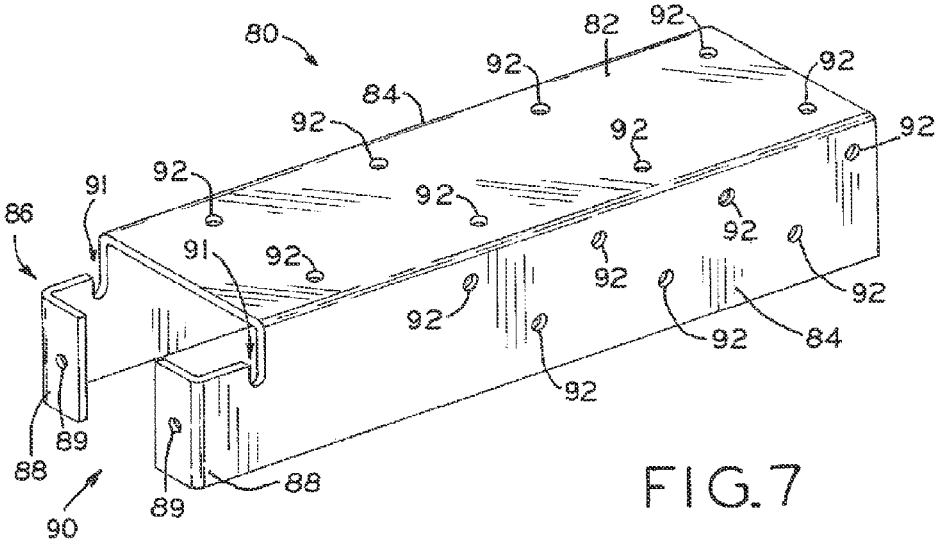
FIG. 7 is a perspective view of a bracket in accordance with an exemplary embodiment of the present disclosure.

Turning now to FIG. 7, return bracket 80 is illustrated according to an exemplary embodiment of the present disclosure. Return bracket 80 includes top wall 82 and opposing side walls 84 extending perpendicularly from respective side edges of top wall 82. Return bracket 80 also includes front portion 86 including opposing L-shaped arms 88 protruding inwardly toward one another such that an end edge of a first arm 88 is spaced from an end edge of a second arm 88 with opening 90 between end edges of arms 88. Arms 88 each include a respective aperture 89 at a position adjacent the respective end edges of arms 88. Return bracket 80 includes slots 91 formed in the periphery of return bracket 80, as shown, and disposed at a position where arms 88 and respective side walls 84 meet. Return bracket 80 also includes a plurality of spaced discrete connection points 92 disposed along top wall 82 and side walls 84. As shown in FIG. 7, connection points 92 are illustrated as spaced, discrete apertures. In alternate embodiments, connection points 92 can comprise a plurality of spaced discrete projecting pins, hooks, or other types of similar mechanical interfaces.

Figure 8A:
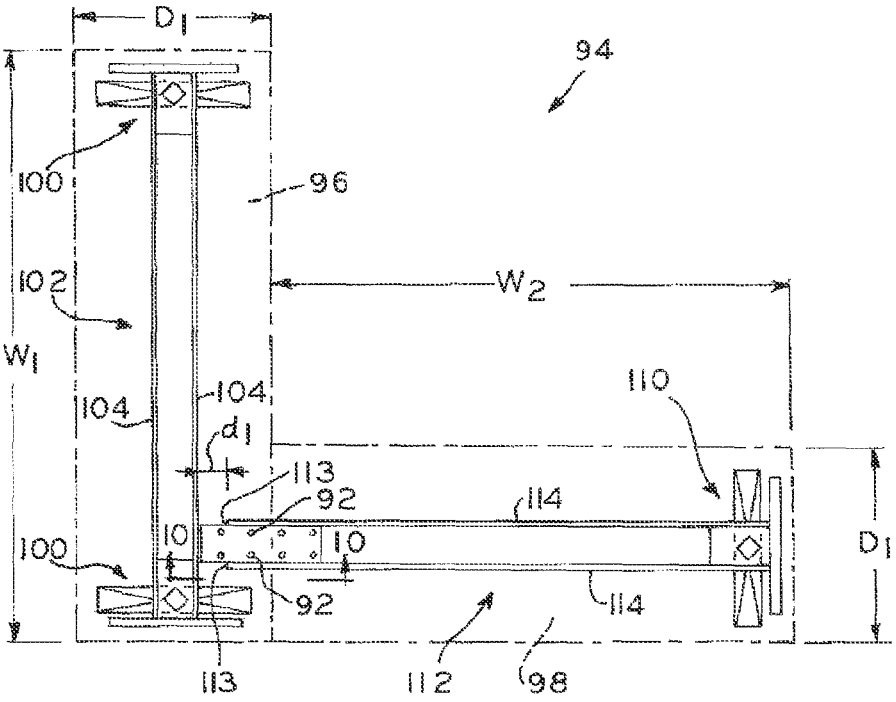
FIG. 8A is a plan view of a table assembly including a table and a desk return illustrating a work surface support assembly of the desk return in a first position relative to the work surface support assembly of the table.

FIGS. 8A-9 illustrate table assembly 94 including table or first work surface 96, defining width $W_1$ and depth $D_1$ and supported on table leg assembly 100 and table beam 102. Table assembly also includes desk return or second work surface 98, which is supported by desk return leg assembly 110 and desk return beam 112 and defines width $W_2$ and depth $D_1$. Width $W_2$ of second work surface 98 is different from width $W_1$ of first work surface 96, but depth $D_1$ is the same for both of work surfaces 96, 98. Table beam 102 includes horizontal rails 104, which have a generally J-shaped cross section similar to horizontal rails 42 as illustrated in FIG. 2. The opposing ends of rails 104 are secured to a pair of spaced apart table leg assemblies 100 in a similar manner as described above with respect to rails 42 and leg assemblies 22. Table leg assembly 100 and table beam 102 support first work surface 96 in a similar manner as described above in connection with work surface support assembly 26 of FIGS. 1 and 2. Horizontal rails 104 each include locking lip 106, as best shown in FIG. 10 and described in further detail below.

Desk return beam 112 also includes horizontal rails 114, which have a generally J-shaped cross section similar to horizontal rails 42 as illustrated in FIG. 2. Rails 114 are secured to desk return leg assembly 110 at one end thereof, and to table beam 102 at the other end thereof as described below. Second work surface 98 is supported by desk return leg assembly 110 and desk return beam 112 in a similar manner as described above in connection with work surface support assembly 26 of FIGS. 1 and 2.

Horizontal rails 114 each include rear edge 113, spaced discrete connection points 116 (FIGS. 9 and 10), and locking lip 117. Referring to FIGS. 9 and 10, connection points 116 are illustrated as spaced discrete apertures. In alternate embodiments, connection points 116 can comprise a plurality of spaced discrete projecting pins, hooks, or other types of similar mechanical interfaces. Connection points 116 of horizontal rails 114 are discretely spaced to correspond with the discretely spaced connection points 92 of return bracket 80, as best shown in FIG. 10.

Figure 10:
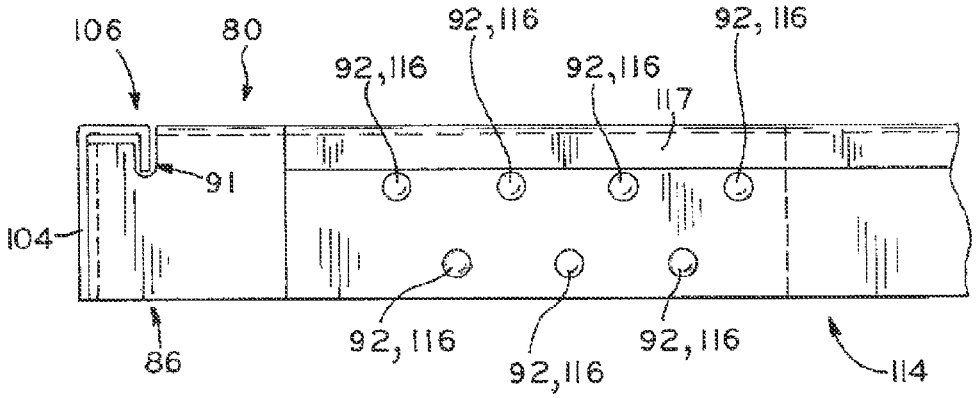
FIG. 10 is a cross-sectional view taken along line 10-10 of FIG. 8A.

Referring to FIGS. 8A-10, an exemplary use of return bracket 80 to modularly secure desk return beam 112 to table beam 102 will now be described. As best shown in FIG. 10, front portion 86 of return bracket 80 is positioned adjacent to horizontal rail 104 of table beam 102 such that locking lip 106 of horizontal rail 104 is received within slots 91 of return bracket 80. In this coupled configuration, apertures 89 (FIG. 7) of arms 88 of return bracket 80 align with corresponding apertures (not shown) formed in horizontal rail 104. Fasteners (not shown) can then be received through apertures 89 and the aligned apertures of horizontal rail 104 to secure return bracket 80 to horizontal rail 104 of table beam 102.

With bracket 80 secured to table beam 102, desk return beam 112 can be selectively attached to return bracket 80. The distance between desk return beam 112 and the adjacent ends of horizontal rail 104 of table beam 102 can be adjusted, i.e., a distance of rear edge 113 of horizontal rails 114 can be placed relatively closer or farther away from the nearest horizontal rail 104 of table beam 102. In the illustrated embodiment, this distance adjustment is accomplished by selectively aligning connection points 92 of return bracket 80 with connection points 116 of horizontal rails 114.

For example, referring to FIG. 9, a first selected set of connection points 116 of horizontal rails 114 can be aligned with a first selected set of connection points 92 of return bracket 80. With connection points 92, 116 of horizontal rails 114 so aligned, rear edge 113 of horizontal rails 114 are spaced from the nearest horizontal rail 104 of table beam 102 by distance $d_1$ as shown in FIG. 8A. Fasteners (not shown) can then be received within the aligned set of connection points 92 and 116 to attach to attach horizontal rails 114 of desk return beam 112 to return bracket 80 in a first position as shown in FIGS. 8A and 9. This first position can be considered one in which table beam 112 is relatively closer to table beam 102, because first distance $d_1$ (FIG. 8A) is less than other distances definable by the illustrated arrangement (e.g., distance $d_2$ shown in FIG. 8B and described below). In this configuration, a first work surface 96 having a relatively smaller depth $D_1$ (FIG. 8A) may be mounted atop table beam 102 and table leg assemblies 100, while remaining centered over table beam 102 and having the desired spatial arrangement with respect to desk return beam 112 (as described in further detail below). In one exemplary embodiment, depth $D_1$ of work surface 96 is 45 inches.

Figure 8B:
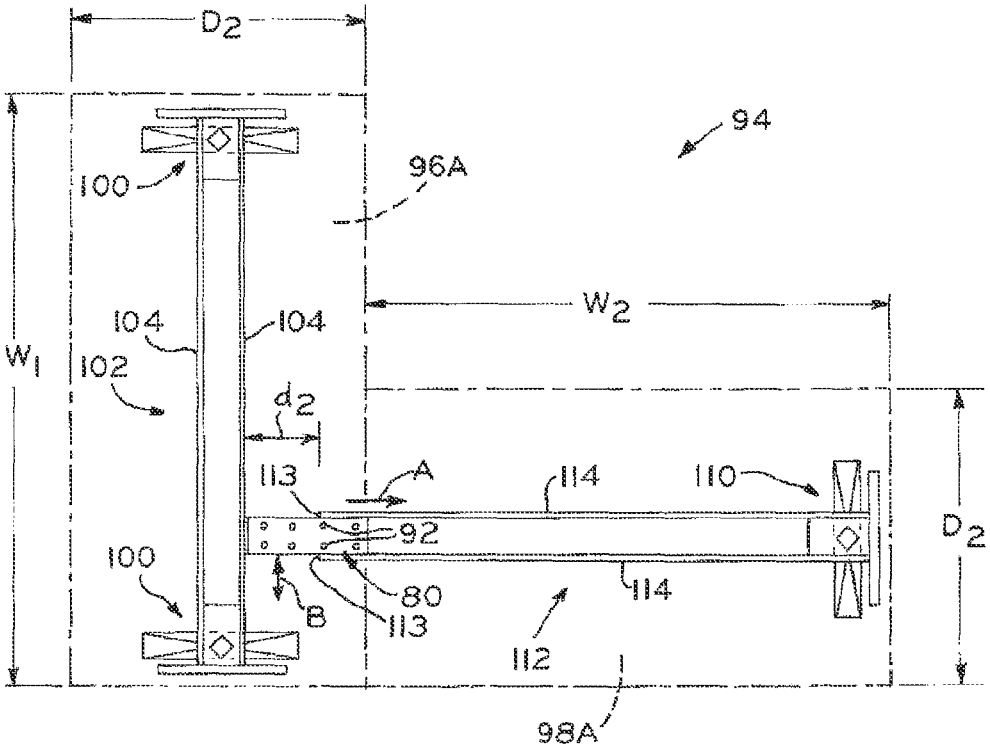
FIG. 8B is a plan view of a table assembly including a table and a desk return illustrating a work surface support assembly of the desk return in a second position relative to the work surface support assembly of the table.

A wider first work surface 96A having a depth $D_2$ greater than depth $D_1$ may be used in conjunction with table beam 102. In one exemplary embodiment, depth $D_2$ is 60 inches. When work surface 96A is used, a similarly wide work surface 98A (arranged as a desk return) can be supported by table beam 102 and desk return beam 112 by adjusting the connection position between desk return beam 112 and return bracket 80. In an exemplary embodiment, this adjustment is performed by changing the distance between rear edges 113 of desk return beam 112 and table beam 102. For example, referring to FIG. 8B, horizontal rails 114 can be moved horizontally outwardly, i.e., generally along arrow A, such that connection points 116 (FIG. 9) of horizontal rails 114 move away from the above-described set of connection points 92 and toward the next adjacent set of connection points 92 of return bracket 80. In FIG. 8B, connection points 116 of horizontal rails 114 are positioned at a third set of connection points 92 of return bracket 80, i.e., the third most-distant set of connection points 92 from horizontal rail 104 of table beam 102, as compared to the positioning in FIG. 8A at a first, least-distant set of connection points 92.

With connection points 116 of horizontal rails 114 positioned in alignment with the third set of connection points 92 of return bracket 80, fasteners (not shown) can be received within respective aligned connection points 92, 116 to attach horizontal rails 114 of desk return beam 112 to return bracket 80 in the new position. As noted above, in this new position rear edge 113 of desk return beam 112 is located a second distance $d_2$ (FIG. 8B) from horizontal rail 104 of table beam 102 greater than first distance (FIG. 8A, and described above). In this configuration, first work surface 96 having increased depth $D_2$ (described above and shown in FIG. 8B) can be centered atop table beam 102 and table leg assemblies 100 as shown in FIG. 8B, while still accommodating second work surface 98 having width $W_2$, which is the same as width $W_2$ of narrower work surface 98. More particularly, the larger depth $D_2$ of first work surface 96A overhangs a greater portion of the overall horizontal span of return beam 112, thereby leaving less of such span available to support second work surface 98A. However, the distance between desk return leg assembly 110 and a respective table leg assembly 100 is increased by the above-described adjustment, which compensates for the larger depth $D_2$ of work surface 96A and allows second work surface 98A to retain the same width $W_2$ used in narrower work surface 98.

The depth $D_2$ of second work surface 98A does not depend on the distance of desk return beam 112 from table beam 102, such that second work surface 98A can have any desired depth such as one of depths $D_1$ and $D_2$, for example. In order to maintain flush outer edges between work surfaces 96A, 98A, return beam 112 may be moved along direction B prior to attachment of return bracket 80 to the adjacent horizontal rail 104 (as described in detail above).

In this manner, a single return bracket 80 cooperates with the work surface support assemblies 26 of table assemblies 20 to allow table assemblies 20 to be selectively configured with work surfaces 96, 98 having varying depths, thereby providing a reconfigurable, modular construction which allows the depth of the work surfaces 96, 98 to be selected as desired.

3. Back-to-Back Work Surface Assemblies

Figure 11:
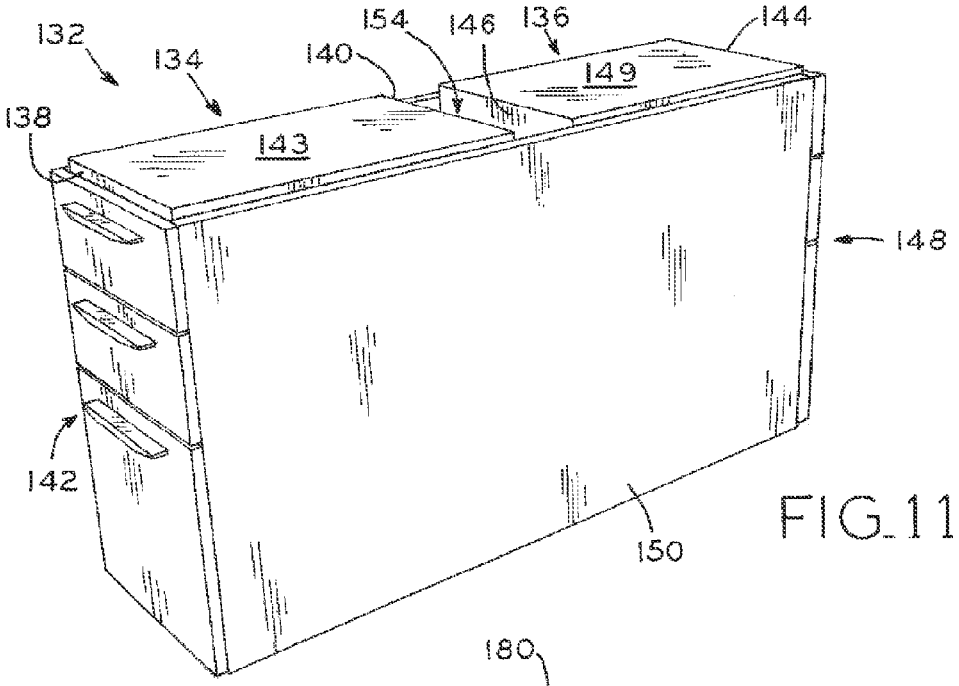
FIG. 11 is a perspective view of a back-to-back pedestal assembly in accordance with an exemplary embodiment of the present disclosure.
Figure 15:
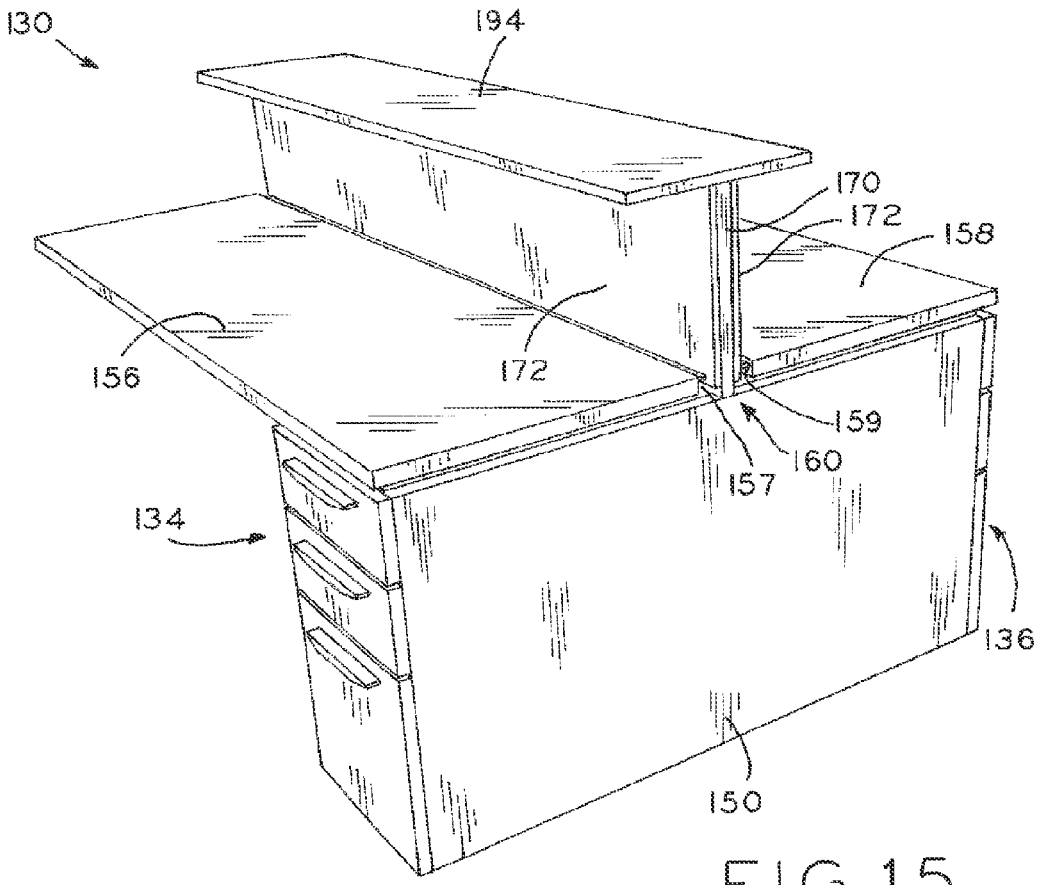
FIG. 15 is a perspective view of a table assembly including a back-to-back arrangement of work surfaces in accordance with an exemplary embodiment of the present disclosure.

Turning now to FIG. 15, back-to-back table assembly 130 is illustrated. In one embodiment, back-to-back table assembly 130 includes back-to-back pedestal assembly 132 (as illustrated in FIG. 11) including first pedestal assembly 134 and second pedestal assembly 136. In other embodiment, back-to-back table assembly 130 may include a modular table leg or a freestanding leg assembly (as described in detail below).

Figure 12:
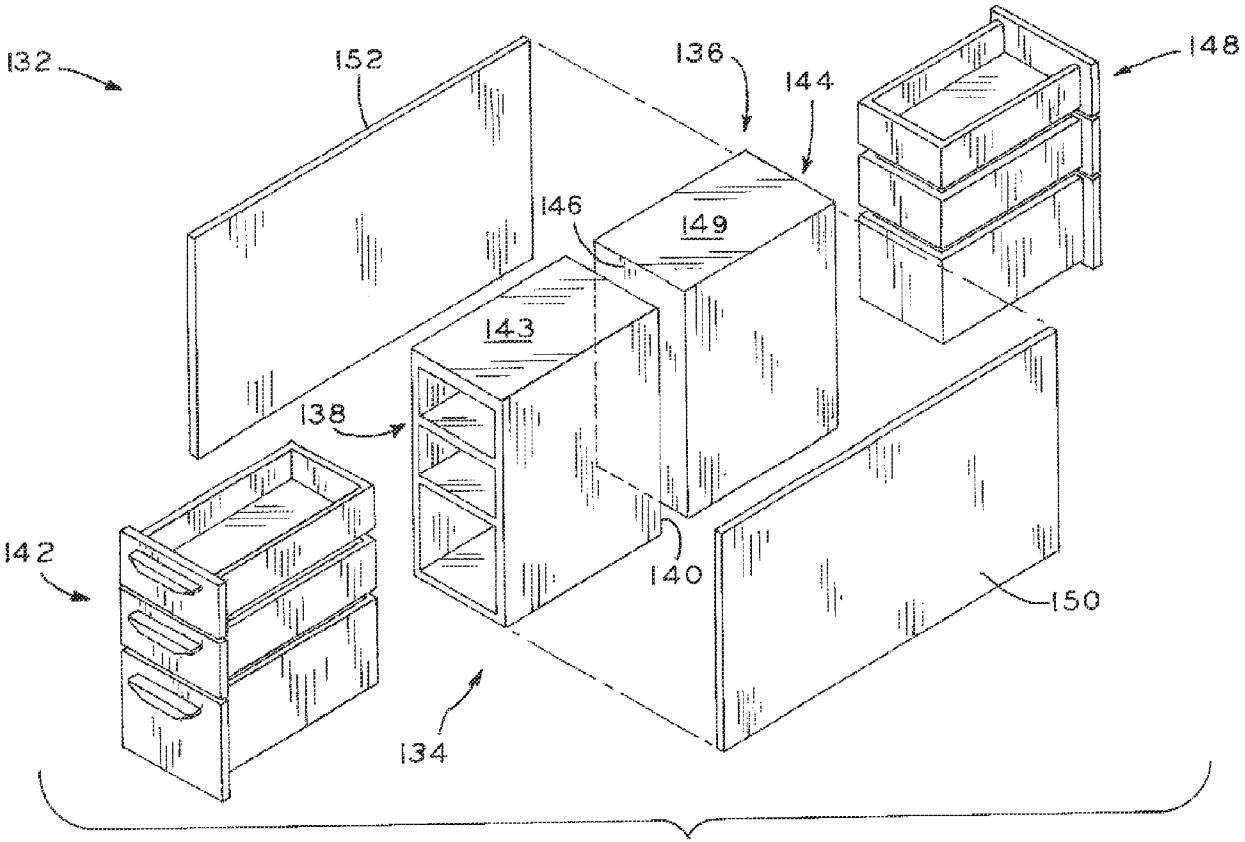
FIG. 12 is an exploded perspective view of the back-to-back pedestal assembly of FIG. 11.

Referring to FIGS. 11 and 12, first pedestal assembly 134 includes front end 138, opposing rear end 140, top surface 143, and drawer assembly 142 including a series of drawers slidably received within front end 138 of first pedestal assembly 134. Similarly, second pedestal assembly 136 includes front end 144, opposing rear end 146, top surface 149, and drawer assembly 148 including a series of drawers slidably received within front end 144 of second pedestal assembly 136.

In the illustrative embodiment of FIG. 11, elongated panel 150 connects first pedestal assembly 134 and second pedestal assembly 136, with rear end 140 of first pedestal assembly 134 spaced from rear end 146 of second pedestal assembly 136 with opening 154 between rear end 140 of first pedestal assembly 134 and rear end 146 of second pedestal assembly 136. In other embodiments, a second elongated panel 152 (FIG. 12) is also used to connect the opposite sides of first pedestal assembly 134 and second pedestal assembly 136. In still further embodiments, the pedestal assemblies 134 and 136 may themselves lack vertical side walls, such that panels 150 and 152 themselves form common side walls of pedestals 134 and 136. In such embodiments, drawer slides (not shown) for the individual drawers of drawer assemblies 142 and 148 may be mounted to the interiorly-facing surfaces of panels 150 and 152.

Referring to FIGS. 11 and 15, with back-to-back pedestal assembly 132 assembled as described above and illustrated in FIG. 11, first work surface 156 having rear end 157 is mounted atop top surface 143 of first pedestal assembly 134. Second work surface 158 having rear end 159 is mounted atop top surface 149 of second pedestal assembly 136 in a similar fashion.

Referring to FIG. 15, first and second work surfaces 156, 158 are mounted such that opening 160 is formed between rear end 157 of first work surface 156 and rear end 159 of second work surface 158. In another embodiment, the pedestal assemblies 134 and 136 may themselves lack horizontal top surfaces 143 and 149, such that work surfaces 156 and 158 themselves form the top walls of pedestals 134 and 136. In such embodiments, with reference to FIG. 15, the end edges of work surfaces 156 and 158 may be vertically flush with the vertical outer surface of end panel 150.

Figure 13:
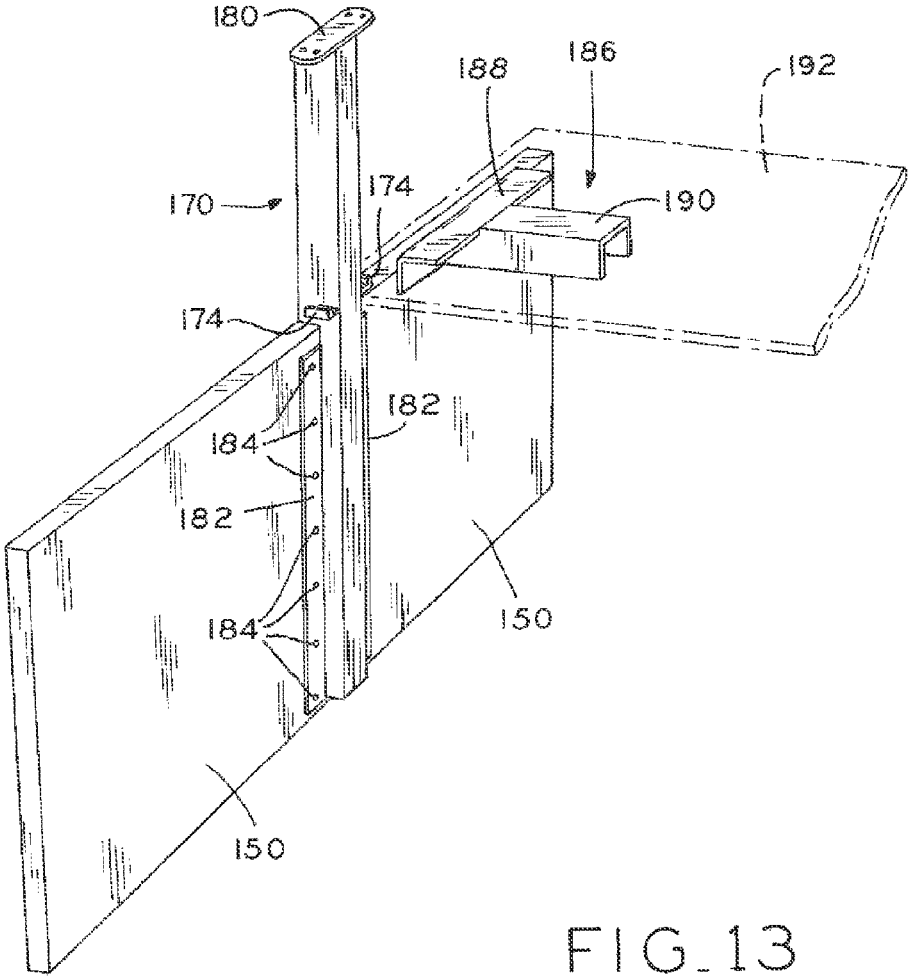
FIG. 13 is a perspective view of a vertical stanchion and end panel in accordance with an exemplary embodiment of the present disclosure, the end panel including a work surface support assembly supporting a work surface shown in dashed lines.

Optionally, referring to FIGS. 13 and 15, back-to-back table assembly 130 can include an end panel having a vertical stanchion 170 to accommodate a privacy panel assembly including privacy screens 172 and/or shelf assemblies (not shown) or modular storage components (not shown). Referring to FIG. 13, vertical stanchion 170 includes first support members or receiving brackets 174 each having a horizontal wall extending outwardly from a surface of stanchion 170 and a vertical wall attached to the surface of stanchion 170. Mutually opposed flanges 182 are attached to, and extend outwardly from, the opposed surfaces of vertical stanchion 170 upon which receiving brackets 174 are mounted. Flanges 182 are disposed near the bottom end of vertical stanchion 170. Flanges 182 include spaced apertures 184 extending the length of flanges 182. A single end panel 150 or a pair of end panels can be secured to vertical stanchion 170 via flanges 182 by securing fasteners through apertures 184 of flanges 182 and into corresponding apertures (not shown) disposed in end panels 150. As illustrated in FIG. 15, with end panel 150 secured to vertical stanchion 170, vertical stanchion 170 and end panel 150 can be integrated into back-to-back table assembly 130 to provide a closed end for the table assembly.

Figure 19:
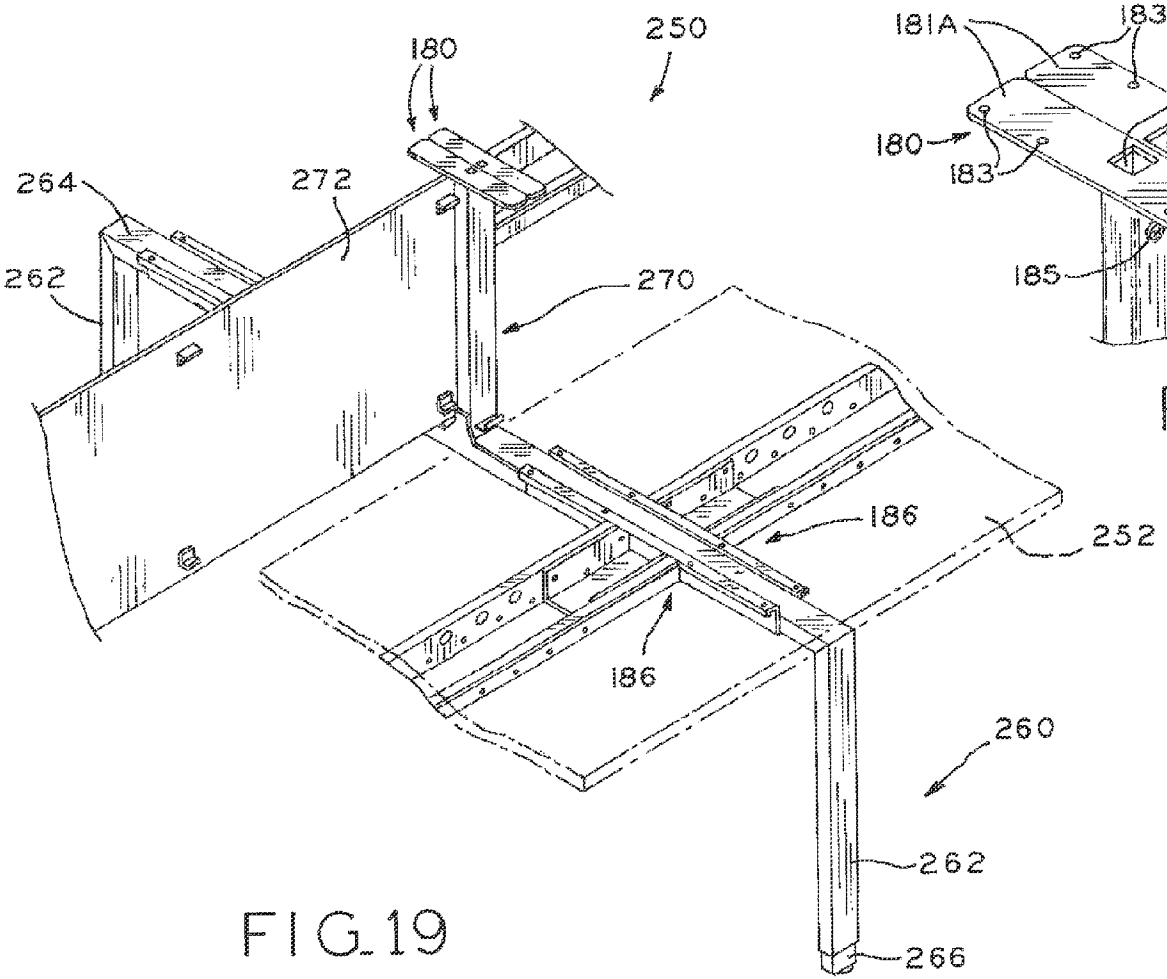
FIG. 19 is a perspective view of a work surface assembly including U-shaped leg made in accordance with the present disclosure, the U-shaped leg including a vertical stanchion and a pair of modular bracket assemblies attached thereto.
Figures 21, 22, 23:
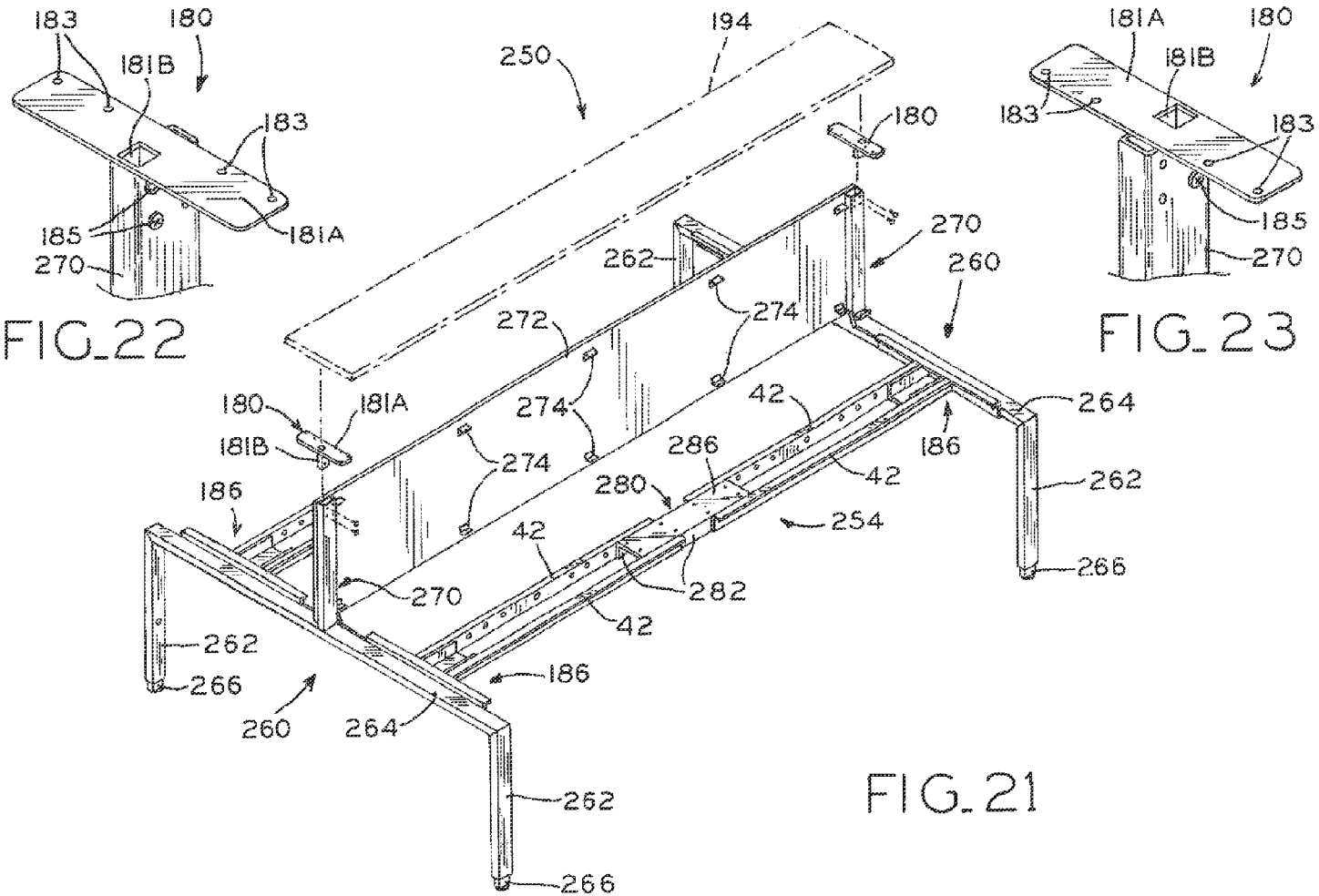
FIG. 21 is a perspective view of another work surface assembly made in accordance with the present disclosure.
FIG. 22 is an enlarged, perspective view of a shelf mounting bracket received within the left vertical stanchion of FIG. 21.
FIG. 23 is an enlarged, perspective view of a shelf mounting bracket received within the right vertical stanchion of FIG. 21.

In another exemplary embodiment illustrated in FIGS. 19 and 21, back-to-back table assembly 250 includes one or more U-shaped support legs 260 each composed of a pair of upright (e.g., vertically oriented), spaced-apart legs 262 fixed (e.g., by welding) to respective ends of a transverse support 264. In an exemplary embodiment, transverse support 264 is horizontal and generally perpendicular to vertical legs 262, though transverse support may be angled with respect to the floor or other support surface upon which table assembly 250 rests. Optionally, sliders 266 may be received within a tubular cavity formed in legs 262. Sliders 266 may be extended from or retracted within legs 262 to raise or lower the vertical height of transverse support 264 (and therefore provide height adjustability to a work surface mounted thereon).

Suspended vertical stanchion 270 rises vertically away from the upper surface of transverse support 264 as illustrated in FIGS. 19 and 21. Similar to vertical stanchion 170 described herein, suspended vertical stanchions 270 disposed on each of the U-shaped support legs 260 cooperate to define a dividing line between the back-to-back work surfaces (e.g., work surface 252 shown in FIG. 19) forming a part of assembly 250. In the illustrated embodiment, this dividing line may be created by privacy screens 272 mounted to one or both opposing surfaces of vertical stanchions 270. For clarity, only one of privacy screens 272 is illustrated in FIGS. 19 and 21, it being understood that a second privacy screen can be mounted to stanchions 270 and to the first privacy screen 272, such as by screen attachment brackets 274. Privacy screen 272 has a lower edge which either abuts or is adjacent to the upper surface of the work surface (e.g., work surface 252), and extends upwardly by any desired distance to an upper edge above the work surface. Thus, privacy screen 272 has a vertical height entirely above the work surface, where it is needed to provide a privacy function between the back-to-back work surfaces on either side of stanchions 270. However, privacy screen does not extend downwardly below the work surface, thereby keeping the underside of table assembly 250 completely open and uninterrupted.

As also noted below, suspended vertical stanchions 270 may provide support for other office devices, such as shelf 194 which may in turn support cabinets, or provide a secondary, elevated work surface above work surface 252. The size, thickness and material of U-shaped support legs 260 may be chosen to be adequate to any intended supported weight of shelf 194 and its contents while not requiring suspended vertical stanchions 270 to extend all the way to the underlying floor, thereby creating a large open space underneath table assembly 250. This large open space contributes to the overall "open floor plan" concept facilitated by table assembly 250, and allows for various modular options in placing additional cabinets (e.g., pedestal assemblies 134 and/or 136 shown in FIG. 12) or other office furniture under the work surfaces of assembly 250.

4. Modular Mounting Brackets and Structures

Figure 17:
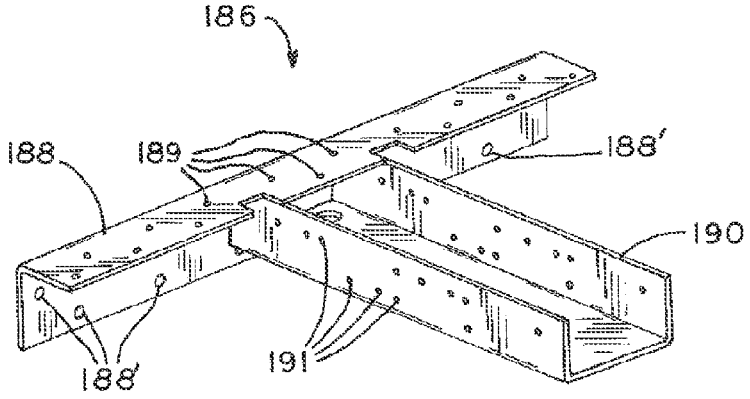
FIG. 17 is a perspective view of a modular bracket assembly made in accordance with the present disclosure.

Referring to FIG. 17, modular mounting bracket assembly 186 includes L-bracket 188 and C-bracket 190 affixed to L-bracket 188, such as by welding. L-bracket 188 defines a longitudinal extent extending substantially perpendicular to the plane of its L-shaped cross section, and C-bracket 190 defines a longitudinal extent extending substantially perpendicular to the plane of its C-shaped cross section. The longitudinal extents of L-bracket 188 and C-bracket 190 are substantially perpendicular to one another with C-bracket 190 disposed at about the middle of the longitudinal extent if L-bracket 188, such that mounting bracket assembly 186 defines a generally T-shaped overall arrangement. As described in greater detail below, brackets 188, 190 each define a plurality of mounting holes 189, 191, respectively, which are sized and positioned to allow bracket assembly 186 to be used for a variety of modular desking system mounting options.

Figure 16:
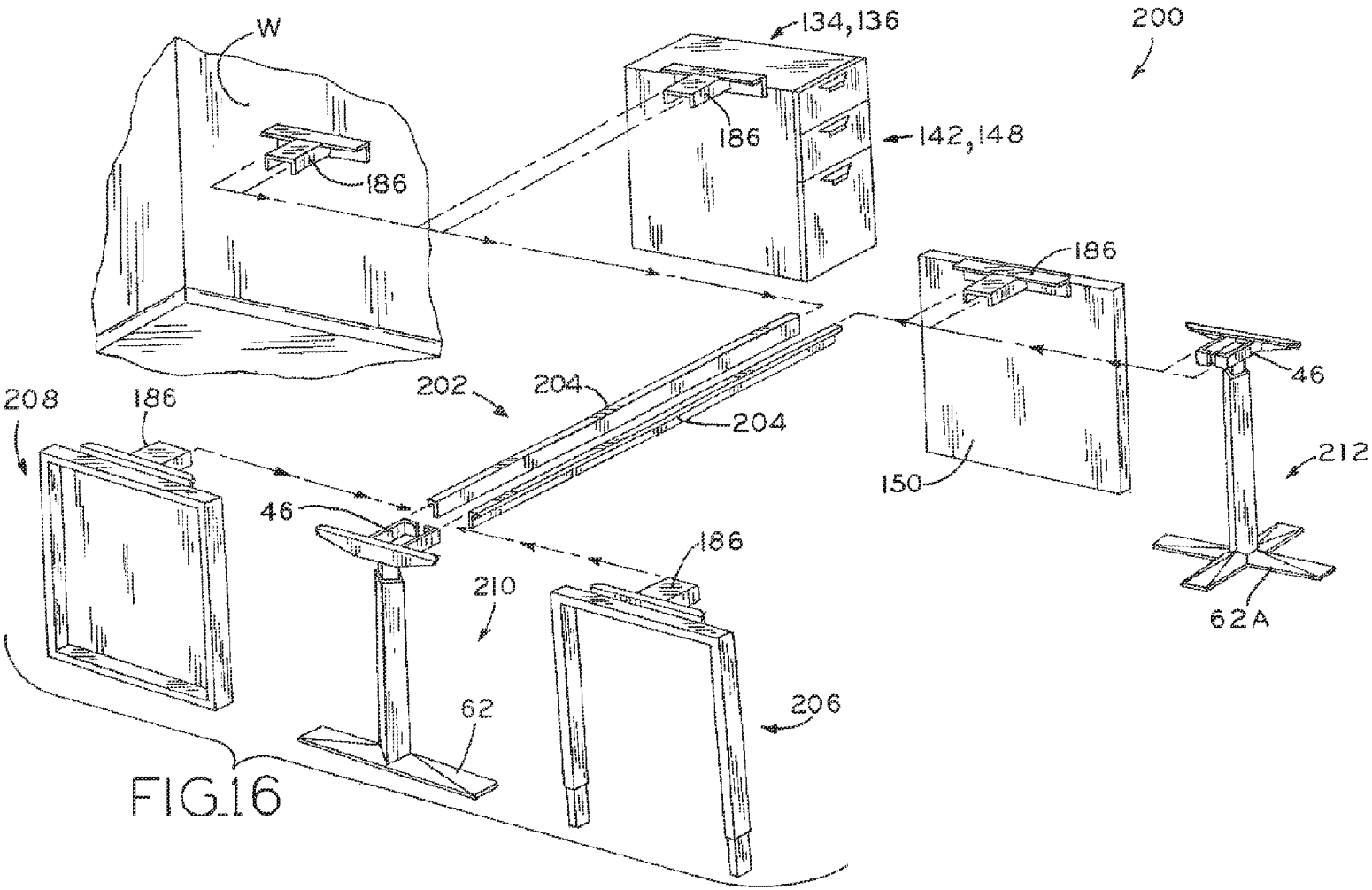
FIG. 16 is an exploded perspective view of an interchangeable leg assembly in accordance with an exemplary embodiment of the present disclosure.

In one embodiment, shown with respect to the right side of end panel 150 in FIGS. 13 and 16, support bracket assembly 186 may be attached to end panel 150 at a top portion thereof to support work surface 192 (FIG. 13) when back-to-back pedestal assembly 132 (FIG. 11) is not used. More particularly, mounting holes 189 of L-bracket 188 are used to fasten support bracket assembly 186 to end panel 150, while mounting holes 191 of C-bracket 190 are used to fasten support bracket assembly 186 to work surface 192 (as shown in FIG. 13 in dashed lines).

In another embodiment, shown in FIG. 21, support bracket assembly 186 can be mounted to the vertically oriented, inwardly-facing surface of U-shaped support legs 260 in similar fashion. Yet another alternative, shown in FIG. 16, is to mount bracket assembly 186 to U-shaped leg assembly 206 or square-shaped leg assembly 208. Moreover, FIG. 16 illustrates that support bracket assembly 186 can be mounted to any vertical surface to provide a mounting platform for a work surface, such as a workspace divider (which may be provided in the form of panel 150), one of pedestal assemblies 134, 136 or another cabinet, or any other suitable office space feature. In addition, support bracket assembly 186 may be mounted directly to wall W within the office space environment. Unlike some other known mounting structures, support bracket assembly 186 can be mounted to any location on such a vertical surface without the use of a track-based mounting system.

To fasten support bracket assembly 186 to U-shaped support leg 260 (or to end panel 150), a plurality of mounting holes 188' are formed at the top of the "T-shaped" arrangement such that the longitudinal axes of mounting holes 188' extend substantially parallel to the longitudinal axis of C-bracket 190. Thus, when holes 188' are used to fasten bracket assembly 186 to U-shaped support leg 260 (or to end panel 150), C-bracket 190 extends away from the mounting surface while L-bracket 188 extends along the mounting surface. When so assembled, the "T-shaped" arrangement lays on its side such that the longitudinal axes of L-bracket 188 and C-bracket 190 are both in a horizontal plane.

To fasten work surface 252 (or work surface 192, or another work surface) to bracket assembly 186, horizontal rails 42 (FIG. 21, also discussed above with respect to FIG. 2) are first attached to holes 191 formed in the sides of C-bracket 190. In an exemplary embodiment, holes 191 are positioned such that the top surfaces of horizontal rails 42 are flush with the top surface of L-bracket 188 upon assembly. Thus, the underside of work surface 252 (FIG. 19) rests on the I-shaped arrangement of top support surfaces formed by L-bracket 188 and horizontal rails 42. Holes 189 can then be used to affix work surface 252 to bracket assembly 186 at each end thereof using fasteners.

U-shaped support legs 260 and/or end panel 150 can similarly include bracket assemblies 186 on two opposing sides to mount a second work surface 252, 192 thereon, or to extend one of work surfaces 252, 192 beyond support legs 260 or end panel 150. In one exemplary embodiment shown in FIG. 19, for example, this arrangement allows extended work surface 252 to span support leg 260. In this way, multiple legs 260 may be arranged in spaced apart relationship such that work surface 252, or a plurality of work surfaces 252 can be arranged to extend along any desired work surface span. Further, the use of bracket assemblies 186 on both sides of support legs 260 preclude the need for a pair of abutting or adjacent leg assemblies, contributing to a cleaner, more uniform appearance and reduced overall system cost.

Figure 14:
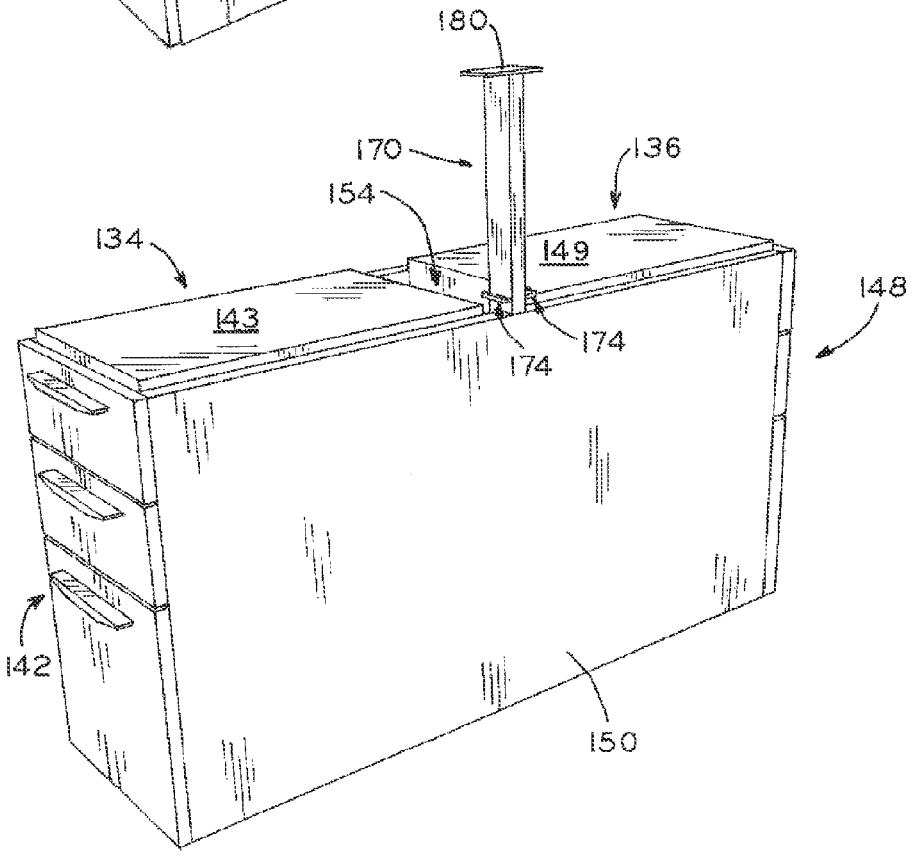
FIG. 14 is a perspective view of the vertical stanchion of FIG. 13 secured to the back-to-back pedestal assembly of FIG. 11.

In other embodiments, end panel 150 may selectively exclude bracket assembly 186, such as is shown on the upper left side of end panel 150 of FIG. 13. In areas where bracket assembly 186 is excluded, back-to-back pedestal assembly 132 (FIGS. 12 and 14) including first pedestal assembly 134 and second pedestal assembly 136 can be used in conjunction with vertical stanchion 170. In one such configuration, shown in FIG. 14, elongated panel 150 supports vertical stanchion 170 and back-to-back pedestal assembly 132.

Referring to FIG. 15, privacy screens 172 are formed from elongate panels that can be used to provide a degree of privacy between work surfaces 156, 158 and can be mounted to vertical stanchion 170 by attaching respective privacy screens 172 to respective receiving brackets 174 (FIG. 13) of vertical stanchion 170. Receiving brackets 174 could be part of privacy screen mounting arrangements made in accordance with the disclosure of U.S. patent application Ser. No. 13/353,669, filed Jan. 19, 2012, entitled "TABLE AND PRIVACY SCREEN ASSEMBLY", and commonly assigned with the present application, the entire disclosure of which is hereby expressly incorporated herein by reference.

Similarly, privacy screens 272 (FIGS. 19 and 21) may be formed as elongate panels and provided as part of back-to-back table assembly 250. Screens 272 are modularly attachable to suspended vertical stanchions 270, such as by direct mounting or by bracket arrangements similar to brackets 174 described above. Screens 272 may also be attached to one another via mating brackets 274 disposed at corresponding locations on the inwardly-facing surface of each of a pair of adjacent screens 272, it being understood a second screen adjacent to privacy screen 272 may be provided in the arrangement illustrated in FIGS. 19 and 21.

As noted above, transaction counter or shelf 194 can be mounted above and supported by vertical stanchions 170 or suspended vertical stanchions 270. The upwardly facing support surface receiving shelf 194 is provided by shelf receiving bracket 180, as best seen in FIGS. 19-23. Shelf receiving bracket 180 is received within an open bore formed in vertical stanchions 170, 270 so that vertical stanchions 170, 270 provide a stable foundation of support for a shelving assembly (not shown) and/or modular storage components (not shown) can be mounted on shelf 194 above the primary work surfaces (e.g., work surfaces 156, 158, 192 and/or 252) and privacy screens 172, 272.

The orientation of shelf receiving bracket 180 is reversible to allow for its modular use at a left-most location (FIG. 22), right-most location (FIG. 23), or center location (FIG. 20), such that a plurality of shelf receiving brackets 180 can be used to support shelf 194 along its entire extent, regardless of the overall length of the work table assembly. Shelf receiving bracket 180 includes a mounting plate 181A with a coupling protrusion 181B extending downwardly therefrom in an offset location, as detailed below. Mounting plate 181A has a plurality of holes 183 formed therethrough sized to receive fasteners for affixing shelf 194 to shelf receiving bracket 180. As best illustrated in FIGS. 22 and 23, mounting plate 181A is offset with respect to coupling protrusion 181B.

In the exemplary embodiment illustrated in the Figures, vertical stanchion 270 is made from a rectangular tube. Coupling protrusion 181B is received in the rectangular tube such that protrusion 181B substantially occupies the inner space of the rectangular tube across the short dimension of the rectangle, but occupies half or slightly less than half of such inner space across the long dimension of the rectangle. Meanwhile, the offset arrangement of mounting plate 181A upon coupling protrusion 181B allows mounting plate to be arranged flush with the outside surface of vertical stanchion 270 while also covering a substantial portion (i.e., more than half) of the opening at the top of the rectangular tube. For example, FIG. 21 illustrates a left-most configuration of bracket 180 in which coupling protrusion 181B is biased to the left side of stanchion 270 and mounting plate 181A substantially covers the opening formed in the top of stanchion 270 while remaining flush with the outside (i.e., left) face of stanchion 270. Conversely, FIG. 23 illustrates a right-most configuration of bracket 180 in which bracket 180 has been rotated by 180 degrees with respect to the left-most configuration, thereby maintaining the edge of bracket mounting plate 181A flush with the outside (i.e., right) face of the opposite stanchion 270. This arrangement allows the same bracket 180 to be used at both sides, while still maintaining a flush edge at the right and left vertical stanchions 270 and providing a stable base of support for the ends of shelf 194. The ends of shelf 194 can be secured to stanchions 270 using fasteners to connect an upwardly facing mounting surface of mounting plate 181A to a downwardly facing mounting surface of shelf 194 via holes 183, and using further fasteners 185 to connect protrusions 181B to the stanchions 270 as illustrated.

Figure 20:
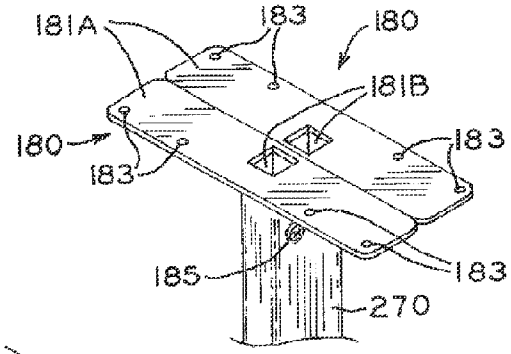
FIG. 20 is an enlarged, perspective view of a pair of adjacent shelf mounting brackets received within the vertical stanchion shown in FIG. 19.

In addition, FIGS. 19 and 20 illustrate how a pair of brackets 180 can be used with a single center stanchion 270 in the middle of a long span of work surface 252 and shelf 194 (shown in FIG. 21, it being understood that shelf 194 can have any desired length). In this case, a pair of adjacent protrusions 181B received within the rectangular opening at the top of stanchion 270 cooperate to substantially fill the opening. The off-center mounting plates 181A therefore extend past the left and right surfaces of stanchion 270, thereby proving a large-area, stable surface of support for the middle of a shelf. Moreover, there is no need for the edges of mounting plates 181A to be flush with either edge of stanchion 270 because shelf 194 extends past both such edges.

Turning now to FIG. 16, interchangeable leg assembly 200 is illustrated including beam 202 having horizontal rails 204 having a J-shaped cross sectional shape, as described above with respect to table beam 102 and horizontal rails 104. Beam 202 can be secured to leg assemblies 210, 212 in a similar manner as described above in connection with, e.g., leg assemblies 22 and work surface support assembly 26 of FIGS. 1 and 2. More particularly, leg assemblies 210, 212 each include bracket support member 46 which are selectively mountable to beam 202 to provide a stable support assembly for a work surface. However, leg assembly 210 includes a T-shaped base including foot member 62, while and X-shaped base leg assembly 212 includes an X-shaped base including foot member 62A. Leg assemblies 210, 212 are readily interchangeable with beam 202.

Alternatively, interchangeable leg assemblies 200 can include U-shaped leg assembly 206 or square-shaped leg assembly 208, each of which includes mounting bracket assembly 186 as described above. U-shaped support legs 260 including suspended vertical stanchion 270 may also be used in the interchangeable leg assembly 200 in a similar fashion. As noted above with respect to U-shaped support legs 260, mounting bracket assembly 186 can be selectively attached via holes 188' (FIG. 17) to any of leg assemblies 206, 208, 260, or to any other leg assembly having a suitably oriented vertical wall.

Thus, any combination of leg assemblies 206, 208, 210, 212, 260 may be selected and attached to beam 202 via bracket support member 46 or bracket assembly 186. Once a desired combination of leg assemblies 206, 208, 210, 212 and a desired length and spatial arrangement of beam 202 has been selected and assembled, one or more work surfaces can be mounted atop and supported by beam 202 and the selected leg assemblies.

Figure 18:
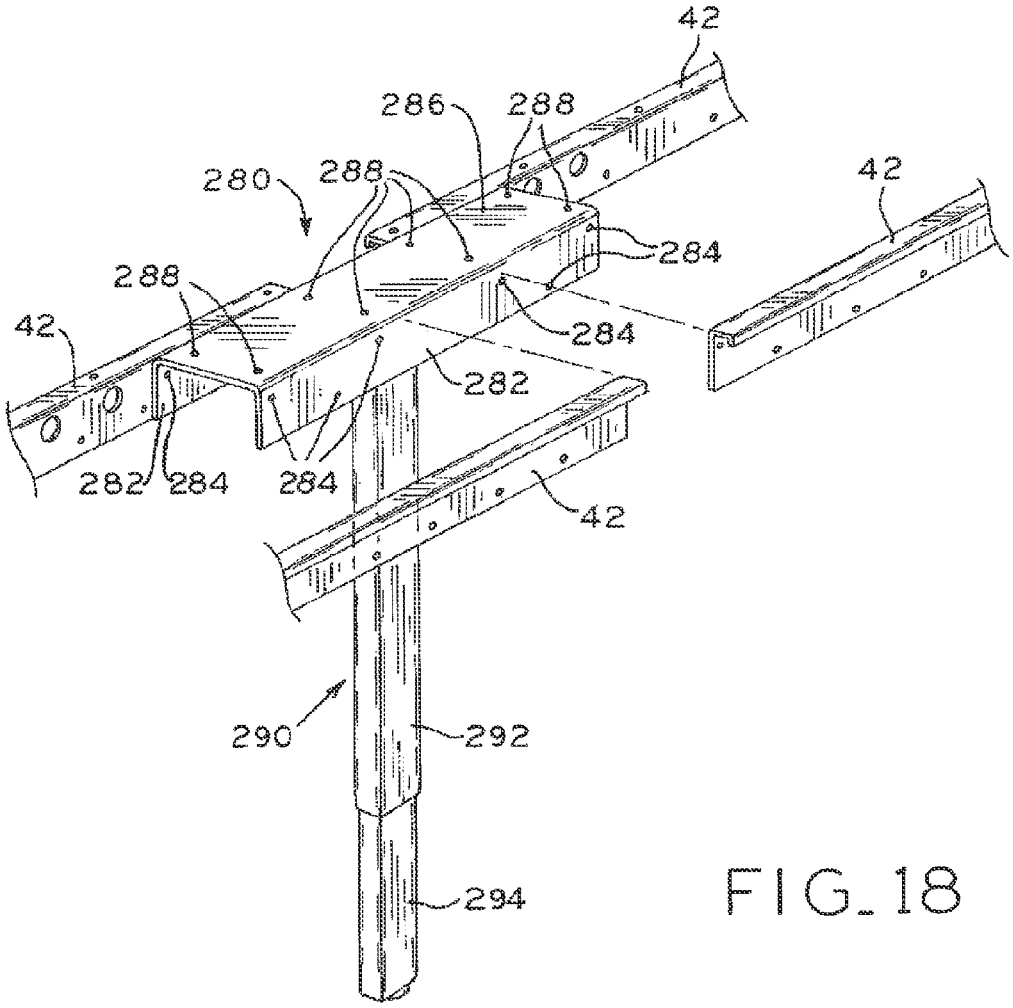
FIG. 18 is a perspective view of a rail connection bracket made in accordance with the present disclosure, shown in two pairs of rails and an auxiliary leg attached thereto.

Turning back to FIG. 21, bridging bracket 280 is illustrated in the context of back-to-back table assembly 250. In an exemplary embodiment bridging bracket 280, shown in greater detail in FIG. 18, is a C-shaped or U-shaped channel having a longitudinal extent running substantially perpendicular to the C- or U-shaped cross-sectional profile. In an exemplary embodiment, bridging bracket 280 has the same cross-sectional profile as C-bracket 190 of bracket assembly 186, shown in FIG. 17 and described in detail above.

Bridging bracket 280 includes mutually opposed sidewalls 282 having a plurality of holes 284 formed therein and a joining wall 286 spanning sidewalls 282 and having a plurality of holes 288 formed therein. As best seen in FIG. 19, holes 284 in sidewalls 282 can be used to affix respective pairs of horizontal rails 42 to bridging bracket 280. When so assembled, beams 42 ad bridging bracket 280 cooperate to create beam 254, which is similar in overall structure and function to, e.g., beam 102 (FIG. 9) but has an extra-long, effectively uninterrupted span. For example, in one exemplary embodiment, beam 254 creates a 120-inch span between the left and right U-shaped support legs 260. Moreover, such span may be accomplished without any impeding structures underneath the work surfaces mounted atop beam 254, thereby contributing the open-floor plan modular functionality of table assembly 250. However, in some instances, such as where beam 254 supports heavy loads or has an even longer span, leg 290 may be attached to bridging bracket as shown in FIG. 18. Similar to legs 262 of U-shaped support legs 260 (FIG. 21), leg 290 may include an outer leg member 292 with an inner slider 294 received therewithin, such that slider 294 can be extended or retracted to accommodate differing overall heights of beam 254 (and therefore of the work surfaces mounted thereon).

With beam 254 assembled and installed as shown in FIG. 21, a work surface (e.g., one of work surfaces 192, 252 shown in FIGS. 12 and 19 respectively) may be affixed to bridging bracket 280 via holes 288 formed in joining wall 286.

5. Modular Desking Hubs

Turning now to FIGS. 24-27, modular desking hubs are shown, around which various of above-mentioned structures may be modularly arranged to provide a wide variety of work surface arrangements as desired or required for a particular application and/or work space. As described in detail below, such desking hubs may also be interconnected with one another in any arrangement to provide a highly configurable desking system for any size work space.

Figure 24:
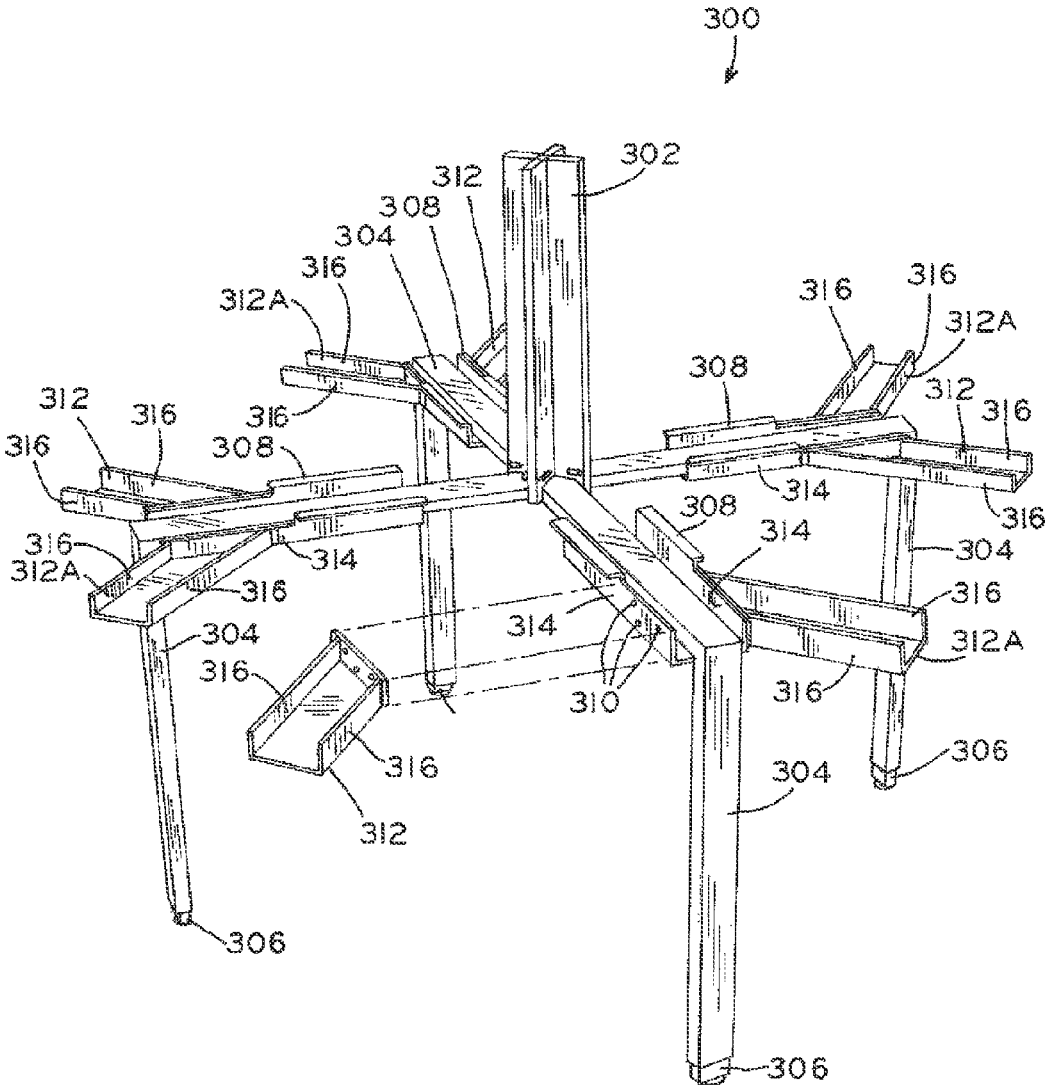
FIG. 24 is a perspective view of another modular work surface assembly made in accordance with the present disclosure.
Figure 25:
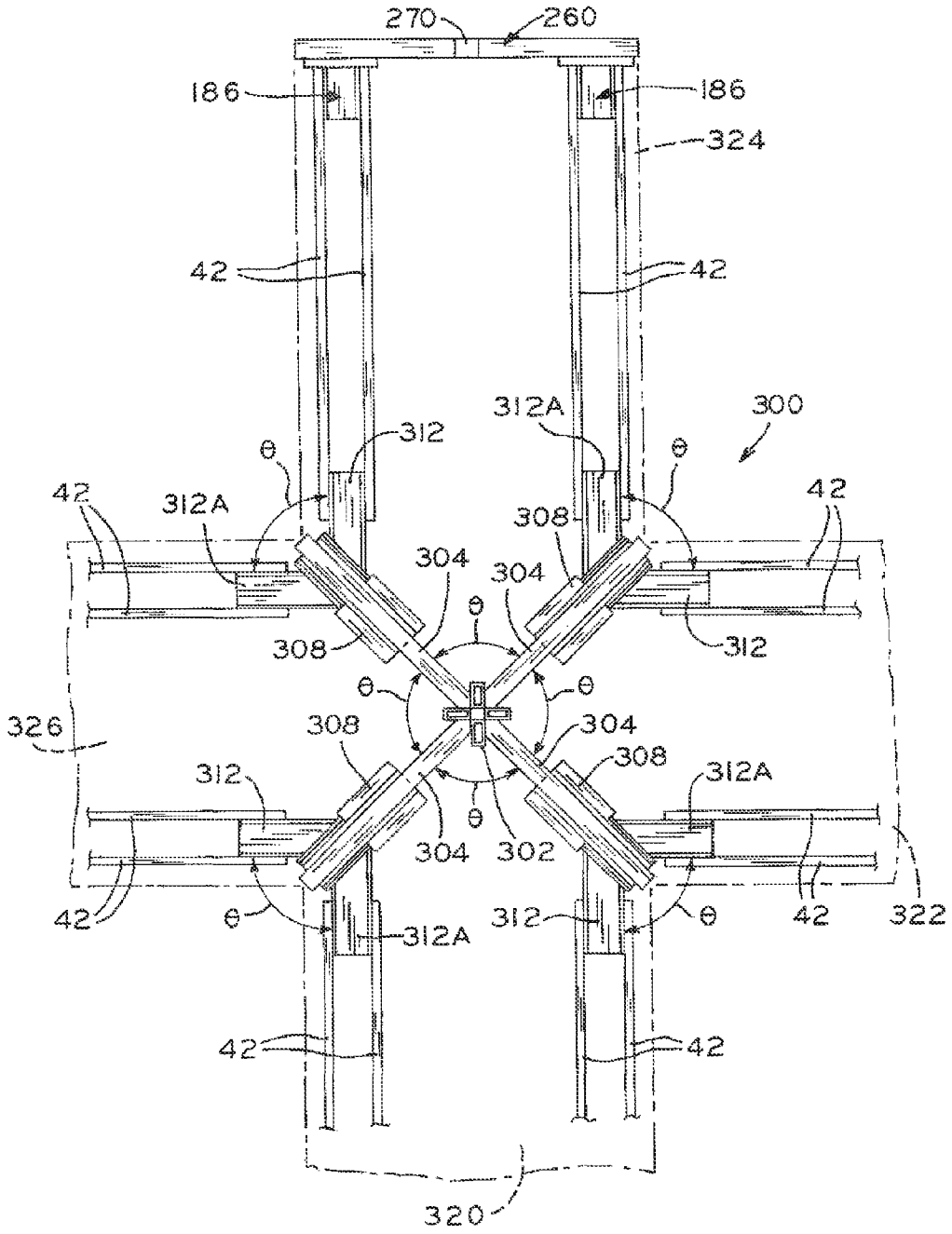
FIG. 25 is a plan view of the modular work surface assembly shown in FIG. 24.

FIG. 24 illustrates 4-way desking hub 300 including suspended central stanchion 302 and four legs 304 extending outwardly therefrom. In the illustrated embodiment, each of legs 304 are equally angularly spaced from one another, i.e., each of legs 304 is oriented to define angle Θ equal to 90 degrees with respect to the adjacent legs 304 (FIG. 25). However, other angular arrangements can be utilized, with non-equal angles between adjacent pairs of legs. In an exemplary embodiment, legs 304 may be similar in structure in arrangement to legs 262 of U-shaped support legs 260, shown in FIG. 21 and described in detail above. For example, legs 304 may include sliders 306 for height adjustment, similar in structure and function to sliders 266.

Each of legs 304 has attachment bracket 308 attached thereto, which may be U-shaped or C-shaped channels similar in size and overall structure to C-bracket 190 of bracket assembly 186 (FIG. 17). Similar to C-bracket 190, attachment bracket 308 may have holes 310 formed in sidewalls 314 thereof. Holes can be used to mount horizontal rails 42, for example. However, in the illustrated embodiment, angular bracket 312 is attached to one of sidewalls 314 and angular bracket 312A is attached to the opposing sidewall 314. Angular mounts 312, 312A are mirror images of one another about the longitudinal axis of symmetry of attachment bracket 308.

Angular mounts 312, 312A each include sidewalls 316 adapted to receive horizontal rails in a similar fashion to the sidewalls of C-bracket 190 of bracket assembly 186 (such as by including appropriately sized and spaced apertures in sidewalls 316). Thus, as shown in FIG. 25, pairs of horizontal rails 42 (also shown in FIG. 2 and described in detail above) may extend away from each of angular mounts 312, 312A to form a support for a work surface in similar fashion as described above. Moreover, each adjacent pair of angular brackets 312, 312A is arranged and assembled to provide a 90-degree angle between their respective sidewalls 316, such that neighboring pairs of angular brackets 312, 312A, i.e., those pairs mounted on different legs 304 but facing one another, define parallel sidewalls 316. These parallel but spaced-apart neighboring pairs of angular brackets 312, 312A allow two pairs of parallel horizontal rails 42 to be mounted to sidewalls 316, which in turn form support beams for work surfaces as described in detail above.

For example, as shown in FIG. 25, work surfaces 320, 322, 324, 326 are all supported by two pairs of mutually parallel (in plan view) horizontal rails 42. Thus, desking hub 300 provides for four work surfaces outwardly extending from central stanchion 302 (or eight work surfaces, if each adjacent pair of horizontal rails supports a separate work surface in the manner described above). Other structures discussed herein may in turn be attached to the other end of respective pairs of rails 42, such as U-shaped support leg 260 as shown in FIG. 25.

Figure 26:
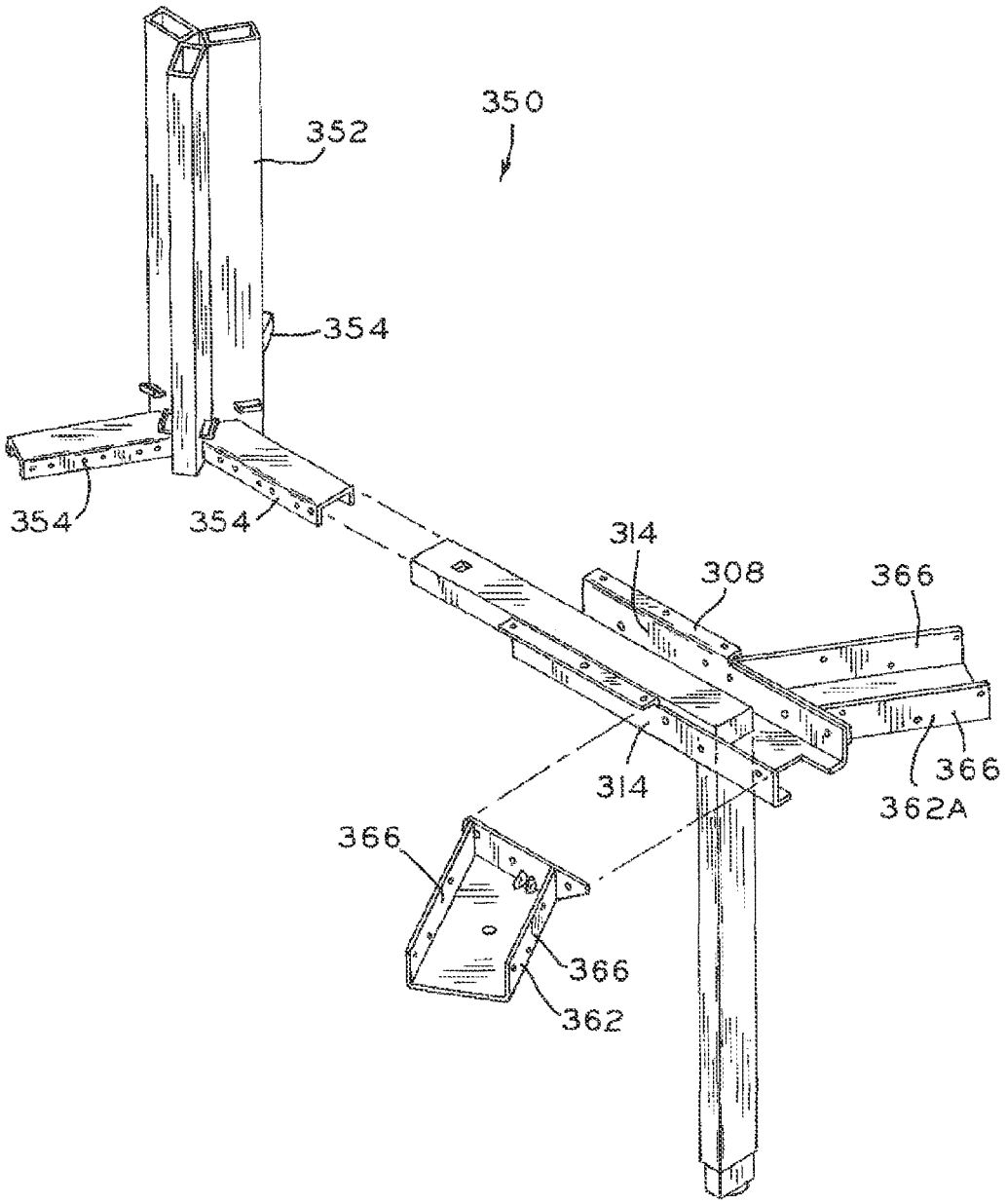
FIG. 26 is a perspective view of yet another modular work surface assembly made in accordance with the present disclosure.

Turning to FIG. 26, a 3-way desking hub 350 is illustrated. 3-way desking hub 350 is similar to 4-way desking hub 300, except that 3-way desking hub 350 includes only three legs 354 extending from suspended central stanchion 352. Similar to 4-way desking hub, each of legs 354 has a attachment bracket 308 attached thereto; FIG. 26 illustrated only one of such brackets 308 attached to legs 354, it being understood that the other legs 354 have brackets 308 similarly attached (as illustrated, for example, in FIG. 27).

Figure 27:
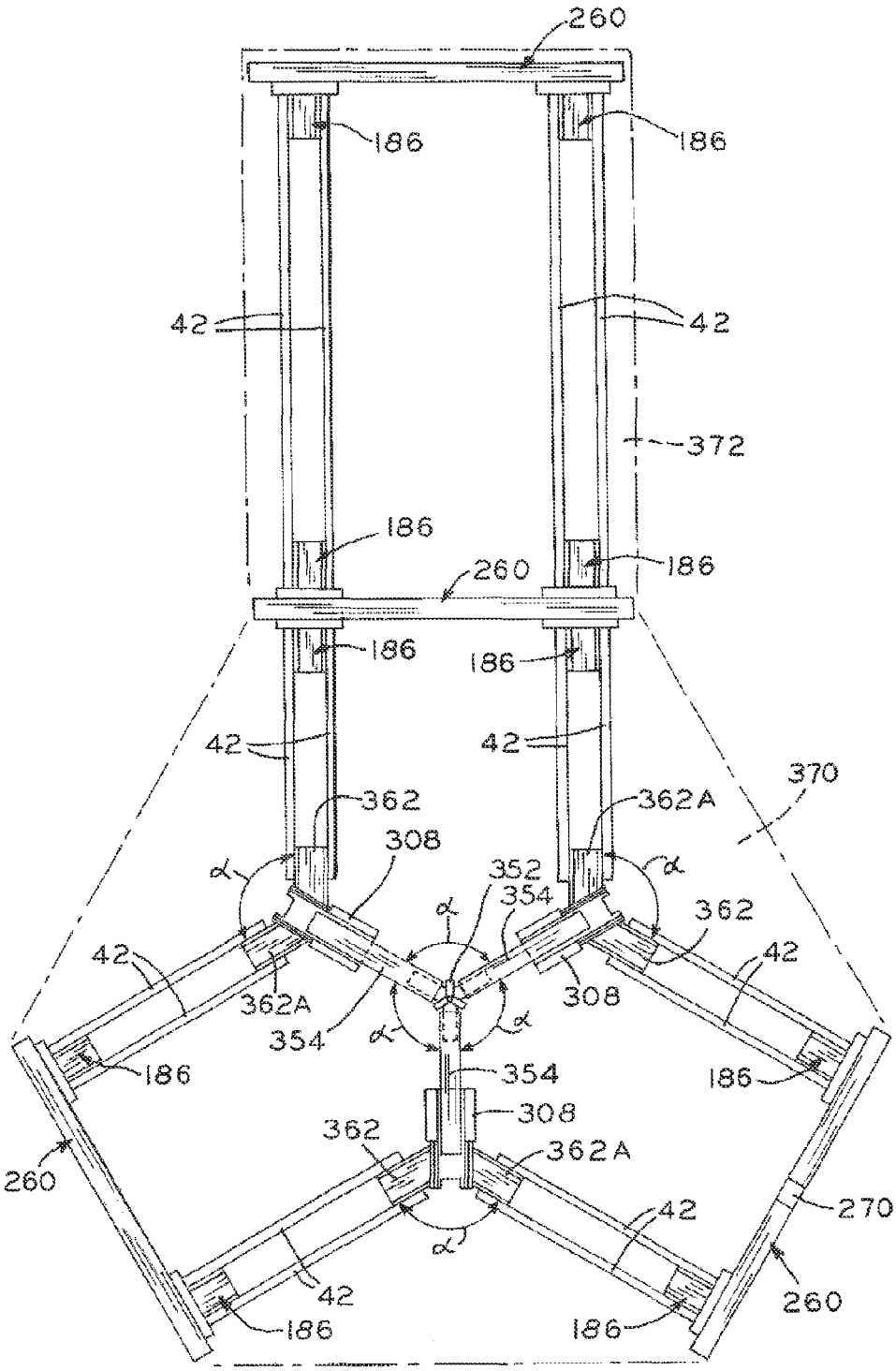
FIG. 27 is a plan view of the modular work surface assembly shown in FIG. 26.

Angular brackets 362, 362A are attached to opposing sidewalls 316 in similar fashion to angular brackets 312, 312A. However, angular brackets 362, 362A have a different geometrical arrangement, defining a larger angle with respect to the longitudinal extent of legs 354. As illustrated in FIG. 27, adjacent pairs of legs 354 define angle $\alpha$ therebetween, as do adjacent pairs of angular brackets 362, 362A attached to one of attachment brackets 308. Thus, adjacent but spaced apart pairs of angular brackets 362, 362A can have parallel pairs of horizontal rails 42 extending therefrom, creating a stable base of support for a work surface as shown in FIG. 27. In an exemplary embodiment all three legs 354 are equally angularly spaced from one another, such that angle $\alpha$ is 120 degrees. However, angle $\alpha$ can potentially vary between adjacent pairs of legs 354.

Similar to 4-way desking hub 300, 3-way desking hub 350 is amenable to many different modular work surface configurations. For example, as shown in FIG. 27, each set of four parallel horizontal rails 42 may be joined at its far end to a U-shaped support leg 260 via bracket assembly 186, as described in detail above. This may support a hexagonal work surface 370. Any of U-shaped support legs 260, such as the top support leg 260 as shown in FIG. 27, may in turn include a second pair of bracket assemblies 186 to extend another set of horizontal rails 42 away from 3-way desking hub 350, which may in turn attach to another, spaced away support leg 260 via yet another pair of bracket assemblies 186. This arrangement allows for a rectangular work surface 372 to be supported on the resulting beams.

Of course, any of the support legs 260 used in the modular arrangements of FIGS. 25 and 27 may include suspended vertical stanchion 270, as shown in FIG. 21 and discussed in detail above. As shown in FIGS. 24 and 26, each of desking hubs 300, 350 includes brackets 174 (also shown in FIG. 13 and described above) to aid in mounting privacy screens 172, 272 to extend between one of desking hubs 300, 350 and one of vertical stanchions 170, 270, for example.

6. Modular Seating System

Figure 28:
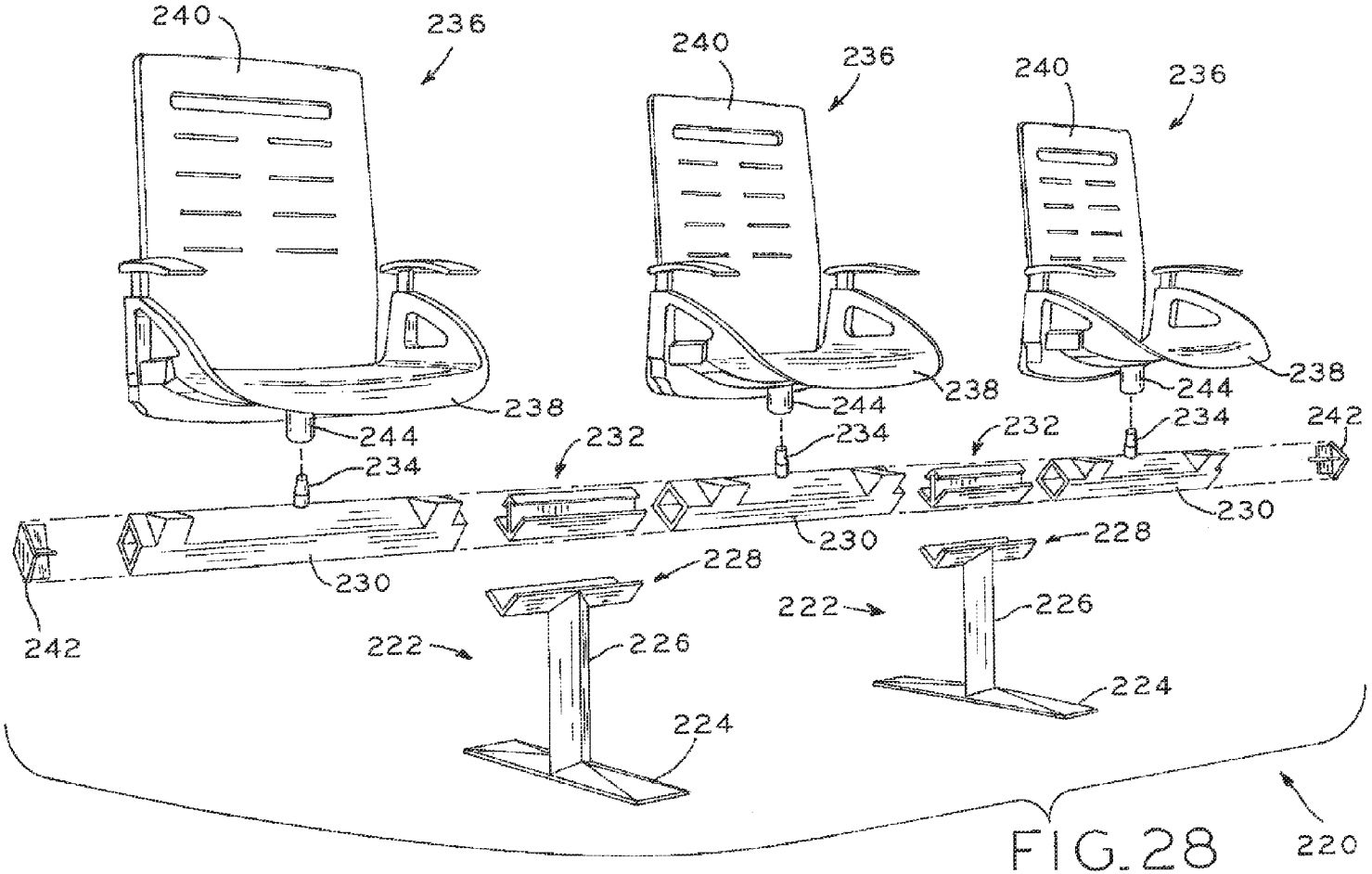
FIG. 28 is an exploded perspective view of a beam-based seating system in accordance with an exemplary embodiment of the present disclosure.
Figure 29:
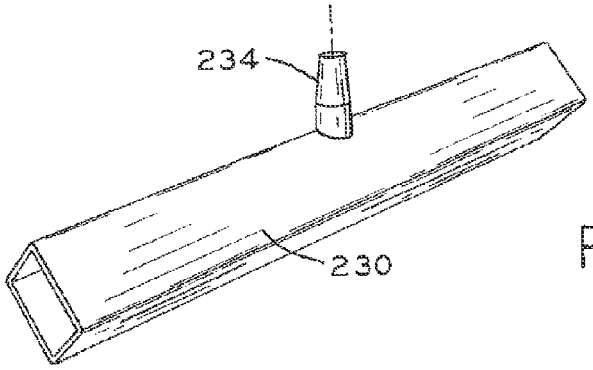
FIG. 29 is a perspective view of a modular rail support member including a tapered chair mounting member.
Figure 30:
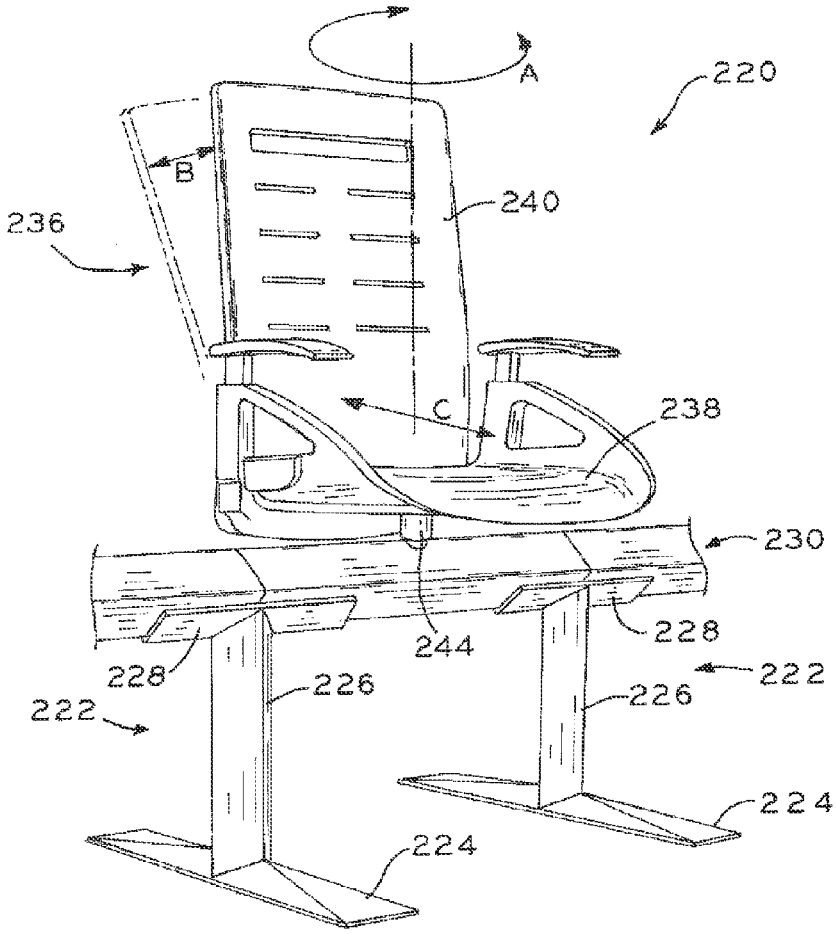
FIG. 30 is an assembled perspective view of the beam-based seating system of FIG. 28, illustrating a task chair in an upright position in solid lines and in a reclined position in dashed lines.

FIGS. 28-30 illustrate beam-based seating system 220. Beam-based seating system 220 includes leg assemblies 222 having foot members 224, vertical columns 226 extending upwardly from foot members 224 and terminating in receiving rails 228, a plurality of modular rail support members 230 connected together by modular rail connection members 232 such that a single modular rail connection member 232 is used to connect two modular rail support members 230 thereto-together, and end caps 242 are used to close respective ends of modular rail support members 230. With modular rail support members 230 connected in this manner, modular rail support members 230 can be positioned atop receiving rails 228 of leg assemblies 222. Vertical columns 226 are oriented 45 degrees relative to respective foot members 224, in similar fashion to the connection between vertical column member 28 to foot member 34 as shown in FIG. 1 and described above.

Each modular rail support member 230 includes tapered chair mounting member 234 extending upwardly from a top portion of a respective modular rail support member 230. Tapered chair mounting members 234 are formed as tapered cylinders onto which the chair control assembly of a task chair may be press-fit, for example. In this manner, as illustrated in FIG. 28, a plurality of task chair assemblies 236 having respective receiving posts 244 extending from a bottom portion of respective task chairs 236 can be secured to respective tapered chair mounting members 234 of respective modular rail support members 230. Each task chair 236 includes seat portion 238 and backrest portion 240.

Referring to FIG. 29, in one embodiment, tapered chair mounting member 234 comprises a tapered post mounting feature for seat assemblies. Taper interfaces are commonly used in connection with known task chairs of the type having a base including a plurality of support legs with caster wheels and a single pneumatic height adjustment cylinder. The upper portion of the cylinder may have a tapered interface for fitting within a hub of a chair control mechanism, for example. Known task chairs having the foregoing construction are available from Kimball Office of Jasper, Ind., and such known task chairs are often equipped with ergonomic adjustment and comfort features such as backrest recline mechanisms, seat depth adjustment mechanisms, etc.

As described below, beam-based seating system 220 provides a seating system in which the foregoing types of ergonomic adjustment and comfort features of known task chairs are preserved. In this manner, tapered chair mounting members 234 facilitate mounting of task chair assemblies 236 to a common beam, i.e., a plurality of connected modular rail support members 230 as shown in FIG. 28, while preserving task chair adjustment functions. For example, referring to FIG. 30, each task chair assembly 236 may include a rotation mechanism which allows rotation of task chair 236 in a direction generally along arrow A, a reclining mechanism which allows movement of backrest portion 240 of task chair 236 in a direction generally along arrow B between an upright position shown in FIG. 30 in solid lines and a reclined position shown in FIG. 30 in dashed lines, and a seat depth adjustment mechanism allowing movement of seat portion 238 of task chair 236 in a direction generally along arrow C which allows for back and forth horizontal adjustment of seat portion 238.

It is contemplated that all the various structures of the foregoing disclosure can be utilized modularly with one another in any desired arrangement. For example, any of the support structures, such as walls, U-shaped legs, box-shaped legs, or leg assemblies with a longitudinal or X-shaped foot structure, can be used with any of the horizontal beam assemblies, such as varying lengths of beams utilizing horizontal rails 42, 104, 114, 204 in varying configurations, i.e., angled with a table support beam and desk return support beam, in series to create extra-long beams spans, etc. In these various combinations, a wide variety of work surface support configurations including those detailed above.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A table assembly, comprising:

a first table leg assembly;

a first beam mounted to said first table leg assembly, said first beam defining a first longitudinal beam extent and including a first rail having a downwardly depending locking lip;

a first work surface mounted atop said first beam;

a second table leg assembly;

a second beam mounted to said second table leg assembly, said second beam defining a second longitudinal beam extent oriented substantially perpendicular to said first longitudinal beam extent;

a second work surface mounted atop said second beam; and a bracket connecting said first beam and said second beam, said bracket including at least one downwardly depending slot in which said locking lip of said first rail is received, said second beam adjustably connected to said bracket between a first position and a second position, such that when said second beam is connected to said bracket in said first position, said second beam is located a first distance from said first beam, and when said second beam is connected to said bracket in said second position, said second beam is located a second distance from said first beam, said first distance different than said second distance.

2. The table assembly of claim 1, wherein:

said bracket includes a plurality of spaced connection points; and said second beam selectively connects to one of said plurality of spaced connection points to toggle said second beam between said first and second distances from said first beam.

3. The table assembly of claim 1, wherein said bracket is adjustably connected to said first beam such that said bracket defines a first longitudinal position along the first longitudinal beam extent and a second longitudinal position along the first longitudinal beam extent, said first longitudinal position different from said second longitudinal position, whereby said bracket may be located a variable distance from said first table leg assembly.

4. The table assembly of claim 1, wherein:

said first work surface defines a first work surface width substantially centered about said first beam;

said second work surface defines a second work surface width substantially centered about said second beam when said second beam is connected to said bracket in either of said first position and said second position.

5. The table assembly of claim 1, wherein said bracket includes a pair of L-shaped arms, said arms in abutment with said first rail.

6. The table assembly of claim 1, wherein at least one of said first and second table leg assemblies comprises:

a foot member extending along a horizontal foot longitudinal axis; and a vertical column member secured to said foot member, said vertical column member having at least two pairs of planar walls each oriented at an acute angle with respect to said horizontal foot longitudinal axis, said pairs of walls joined to one another at two respective locations each disposed along a common axis perpendicular to said horizontal foot longitudinal axis.

7. The table assembly of claim 6, wherein said vertical column member defines a quadrilateral cross-sectional shape having four walls, each of the four walls defining said acute angle.

8. The table assembly of claim 6, wherein said vertical column member includes four said walls, said four walls including first and second pairs of walls with the walls of each pair joined to one another at a location disposed along said horizontal foot longitudinal axis.

9. The table assembly of claim 8, wherein said vertical column member includes four said walls having a square shape in horizontal cross-section and including four corners, with each said wall disposed at a 45° angle with respect to said horizontal foot longitudinal axis, and a first pair of said corners disposed along said horizontal foot longitudinal axis and a second pair of said corners disposed along said common axis perpendicular to said horizontal foot longitudinal axis.

10. The table assembly of claim 6, wherein said vertical column member includes at least four said walls, each said wall disposed at a 45° angle with respect to said horizontal foot longitudinal axis.

11. The table assembly of claim 6, wherein said vertical column member has a polygonal shape selected from the group consisting of a triangle, square, pentagon, hexagon, heptagon, and octagon.

12. The table assembly of claim 1, wherein at least one of said first and second table leg assemblies comprises:

a first leg extending between a first lower end and an opposed first upper end;

a second leg extending between a second lower end and an opposed second upper end, the second leg spaced apart from the first leg to define a span therebetween;

a support extending transversely between said first upper end and said second upper end to affix said first leg to said second leg;

a suspended vertical stanchion extending upwardly from said support, said suspended vertical stanchion disposed at a location along said support that is spaced from said first upper end and from said second upper end; and an elongate vertical panel supported by said suspended vertical stanchion.

13. The table assembly of claim 12, further comprising a shelf bracket receivable within said suspended vertical stanchion to provide an upwardly facing mounting surface spaced above said work surface, said shelf bracket comprising:

a mounting plate; and a coupling protrusion extending downwardly from said mounting plate, said coupling protrusion positioned upon said mounting plate such that said mounting plate is offset with respect to said coupling protrusion, whereby said shelf bracket configurable in at least two orientations when received in said suspended vertical stanchion.

* * * * *